United States Patent [19]

Eccleston

[11] Patent Number: 4,524,350

[45] Date of Patent: Jun. 18, 1985

[54] DETECTION LOGIC AND SIGNAL PROCESSING METHOD AND APPARATUS FOR THEFT DETECTION SYSTEMS

[75] Inventor: Larry Eccleston, Concord, Mich.

[73] Assignee: Progressive Dynamics, Inc., Marshall, Mich.

[21] Appl. No.: 358,383

[22] Filed: Mar. 15, 1982

[51] Int. Cl.[3] ..... G08B 13/24

[52] U.S. Cl. ..... 340/572

[58] Field of Search ..... 340/552, 572; 361/152

[56] References Cited

U.S. PATENT DOCUMENTS

| | | | |
|---|---|---|---|
| 2,992,325 | 7/1961 | Leaan | 324/338 |
| 3,758,849 | 9/1973 | Susman et al. | 340/551 X |
| 4,384,281 | 5/1983 | Cooper | 340/572 |

*Primary Examiner*—James J. Gill

*Attorney, Agent, or Firm*—Price, Heneveld, Huizenga & Cooper

[57] ABSTRACT

In an electromagnetic passage surveillance system, first and second receiver means are employed in mutually-spaced locations across a guarded portal to detect perturbations in an electromagnetic field extending across the portal, resulting from presence within the field of a high-permeability, low-coercivity marker. From the outputs of such receivers a sum signal and a difference signal are produced, and the high-order harmonics of the sum signal are emphasized to produce a first analysis signal while the low-order harmonics of the difference signal are emphasized to produce a second analysis signal. The ratio of the first analysis signal to the second, and thus the ratio of high-order to low-order harmonics, is used in logic and processing circuitry to dynamically vary the detection threshold by which the presence of a marker is determined. To enhance sensitivity to various orientations of a marker, the phase characteristics of the electromagnetic field are periodically changed, and the processing circuitry is correspondingly switched. To improve noise rejection, signal reception is blanked out during the energization of the system's electromagnetic field-generation coils, and the processing of received signals is limited to the time segment during which perturbations resulting from a marker are most likely to be present.

56 Claims, 6 Drawing Figures

DETECTION LOGIC AND SIGNAL PROCESSING METHOD AND APPARATUS FOR THEFT DETECTION SYSTEMS

TECHNICAL FIELD

This invention relates in a broad sense to detection systems and apparatus, and more particularly to detection systems principally used in "anti-pilfering", i.e., theft-prevention, systems; more particularly still, the invention relates to that type of detection system in which an alternating electromagnetic field is monitored to unobtrusively and invisibly detect the presence within the field of a small strip of permalloy or like highly-magnetizable (very low coercivity) metal foil which is hidden upon or in articles such as consumer merchandise whose theft or otherwise-impermissible taking is to be detected and prevented.

BACKGROUND OF THE INVENTION

Many prior efforts have been made toward deterring or preventing thefts in the nature of shoplifting, or other undesired removal of "contraband" articles or goods, for example, unchecked library books or the like, and such prior efforts have given rise to a variety of different systems and approaches, based upon different technological phenomena including, for example, detection of permanent magnet pieces, a variety of electromagnetic field applications, microwave systems, infrared or ultraviolet, etc. These rather extensive prior efforts have, quite understandably, advanced the general state of the art in these different fields, and have in general enhanced the degree of success available; however, the desired end is exceedingly difficult from a technological point of view, since the areas to be monitored (in general, doorways or like points of egress) are large in a physical sense, whereas the articles under surveillance are usually relatively small, requiring a proportionally tiny detection element or "marker". Generally speaking, this requires exceedingly high system sensitivity, but it is not only important to detect the illicit passage of contraband material; it is almost equally as important to avoid "false alarms", in which bona fide customers or other innocent persons are wrongly pointed out as carrying stolen or contraband goods through the portal, since this not only leads to immediate wrongful embarrassment of the individual involved, but also is likely to cost the merchant or other proprietor the loss of substantial goodwill and, potentially, possible litigation by those claiming to be damaged by such incidents.

Accordingly, real progress satisfying both of the aforementioned requirements of high sensitivity attended by great selectively has been difficult to achieve and slow in coming. This conclusion is evidenced by the issuance of various patents over a long period of years, each asserting the achievement of improvements, but each followed in time by another patent directed to still a further improvement in a seemingly continuous sequence. By way of example, perhaps the most frequently-employed, and probably the most successful system concept, relates back to the often-noted French Pat. No. 763,681, of P. A. Picard, issued in 1934, in which the technological phenomenom is described as involving electromagnetic field perturbations resulting from the insertion or presence within the field of a piece of magnetic material. In particular, Picard noted the field effects created by the presence of highly-magnetic (high permeability) material such as permalloy, which creates the presence of a number of the higher-order odd harmonics of the fundamental frequency of the applied field (e.g., Picard referred to the presence of the ninth and eleventh harmonic). While a period of almost 50 years has elapsed since the appearance of this patent to Picard, various patents continue to issue from time to time asserting advances in Picard's theories and findings in the area of "pilferage detection" systems of the type noted hereinabove; for example, reference is made to a number of patents issued to Edward Fearon (including U.S. Pat. Nos. 3,631,442, 3,754,226, 3,790,945, 3,820,103, 3,820,104) and to Peterson (U.S. Pat. No. 3,747,086), Elder et al. (U.S. Pat. No. 3,665,449 and 3,765,007) as well as U.S. Pat. No. 3,983,552 to Bakeman. Indeed, a very recent such patent is that issued to Robert Richardson, U.S. Pat. No. 4,300,183, which is directed to and describes various attributes of the underlying concept relating back to Picard.

As stated above, the seemingly continuous advance in the general state of the art, as evidenced by the aforementioned patents, has undoubtedly provided new insights and improvements in the general level of the art, but requirements of truly satisfactory detection systems are very severe and demanding, and the need therefore continues to exist, and in some ways becomes even more pronounced, for truly reliable systems which will unerringly detect relatively small "marker" elements or indicia, while at the same time being essentially immune to a practically endless number of widely-varying metal devices, objects, articles, and components, all of which cause perturbations in the magnetic interrogation field, with resulting detection-actuating results being inevitably present.

BRIEF SUMMARY OF THE INVENTION

The present invention provides new and highly significant improvements in electromagnetic field-type detection systems of the type noted above, which improvements substantially enhance both the sensitivity and the selectivity of such a system, pursuant to which hitherto-unappreciated detrimental effects such as field-perturbing metal structural components in the environment of the egress portal (e.g., field-perturbing ceiling grids overhead and/or field-perturbing reinforcing rods or mesh in structural concrete nearby, etc.) are substantially eliminated as error sources. The improved system provided hereby thus makes it possible to accurately, consistently, and reliably detect the presence of tiny markers or tags of magnetic material and reject, or not detect, the presence of other field-disrupting metal elements or components as, for example, keys, pocketknives, wristwatches, metal containers such as beverage cans or the likw, baby strollers and shopping carts, and a host of other widely-differing apparatus and objects.

In accordance with the invention, a detection system and method is provided with greatly enhanced processing of the marker-detection signals, incorporating a summing and differencing procedure for substantially improved signal-to-noise ratios, in accordance with which a comparatively low frequency component band and a comparatively high frequency component band are separately determined, and utilized in a multiple-step comparative manner to dynamically control the detection alarm threshold. In this manner, a balancing of the frequency components or bands is utilized, to produce alarms only when the ratio of frequency bands is in the appropriate order representative of the actual marker indicia, thereby avoiding false alarms produced by prior systems in response to metal articles whose field-perturbation effects tend to mimic those of the authentic marker, even including those articles which produce similar frequency components but which are distinguishable by the relative amounts of different frequency bands, i.e., the ratio of the signal strength representative of different frequency component bands.

Further in accordance with the invention the method and apparatus provided operates to additively, or constructively, sum representations of detection signals indicative of marker presence within the field, regardless of and continuously consistent with, field alternation phase changes and differences; additionally, the method and apparatus provided differences or subtracts signals representative of non-marker presence (i.e., noise) in order to accurately portray non-marker effects. In this manner, the marker-characterizing signals are comparatively analyzed by reference to the non-marker signals, thus substantially enhancing selectivity.

Somewhat more particularly, in accordance with the present invention detection logic and processing methods and apparatus are provided for examining representations of electrical signals which are produced initially by receiver means that monitor an alternating electromagnetic interrrogation field in which a predetermined marker may be present, so as to accurately and reliably determine the presence, and/or the non-presence, of such a marker in such a field. In accordance herewith, such signal-examining is carried out in a manner having the effect of determining, and using, a first and second composite analysis signal, the first being used to set a first value of a comparison operation and the second such signal being used to set a second such comparison value, such two comparison values being effectively compared in such comparison operation. Preferably, this is accomplished by developing an integrated ambient-representative signal and using the latter to vary a preset threshold in comparison stages whose primary comparison inputs are signals representative of marker presence and marker absence, with the results of such comparisons being summed against each other, and the resultant summation level used to trigger an alarm or indicator showing the verified presence of the marker within the interrogation field. With particular regard to preferred methods and apparatus for selective reamplification and processing of the signals produced initially by the receiver means, prior to the operation of the present detection logic and processing methods and apparatus, reference is made to my co-pending application, Ser. No. 358,299, filed on even date herewith, which is incorporated by reference herein.

A number of additional improvements and advantages are provided in accordance herewith, as described in more detail hereinafter in conjunction with certain preferred embodiments of the invention as depicted in the attached drawings and specifically noted in conjunction therewith for a more meaningful disclosure.

DETAILED DESCRIPTION OF PREFERRED EMBODIMENTS

Figure 1:
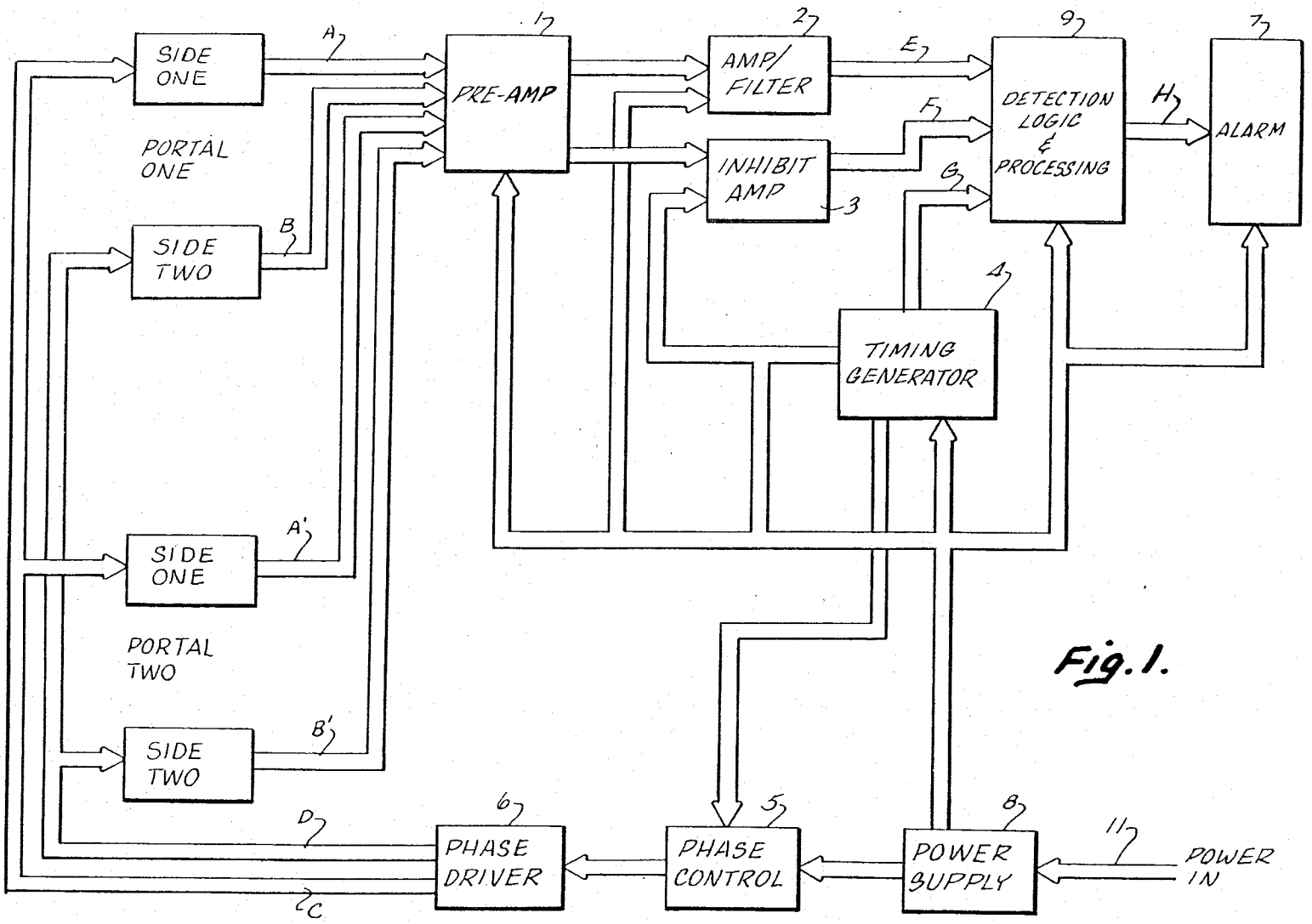
FIG. 1 is a simplified, schematic-form block diagram of the overall detection system in accordance with the invention.

The general nature of the overall system is illustrated in FIG. 1, in which a typical two-portal system is depicted. Generally speaking, such "portals" should be understood as being egress passages, e.g., doorways, on the opposite sides of each of which are maintained electromagnetic interrogation field sources (e.g., induction coils constituting part of an oscillating L-C tank circuit) together with a receiving antenna which monitors the electromagnetic field from that particular side of the portal. As will be understood, many of the prior patents referred to hereinabove depict and discuss systems using such interrogation coils and antennae; for example, Richardson U.S. Pat. No. 4,300,183 depicts a system and components whose general nature may be taken as more-or-less standard, dating back to the work of E. Fearon whose prior patents are also noted above. As illustrated in the aforementioned Richardson patent, wherein the "portals" are designated "doorways", and wherein one of a number of different possible coil shapes and orientations are illustrated, the field-inducing coils are physically large, such that the interrogation field which they produce occupies a physical area which is more than sufficient for a human being to readily pass through. Inasmuch as the general characteristics, attributes, and parameters of such systems, including their field-inducing coils and receiving antennae, have long been known and have, in effect, resulted from the work of a number of individuals working at various points in time, the aforementioned prior patents of Fearon, Elder, Richardson, et al. should be considered as portraying the known state of the art and describing both general system characteristics and circuitry, componentry, and the like; consequently, these patents should, to the extent deemed necessary or desirable for environmental disclosure or otherwise, be considered as incorporated herein by reference.

Referring further to FIG. 1 herein for a very general illustration of the overall system, it will be noted that "portal 1" has a pair of oppositely-spaced sides, designated "side 1" and "side 2", and the same is true with respect to portal 2, which may be considered a substantial duplicate of portal 1. Each side 1 of each portal preferably receives the same type of drive, i.e., interrogation coil-excitation or drive current and each side 2 coil is also driven like its counterparts, although as explained hereinafter the side 2 excitation preferably changes in phase periodically whereas the side 1 excitation does not.

With continued reference to FIG. 1, it will be seen that the signal path from each side of each portal is individually coupled (via channels or paths A and A', and B and B') to a preamp 1, from which two outputs are separately processed, one being directed to an amplifier/filter 2 and the other to an inhibit amplifier 3, whose respective outputs are coupled on paths E and F to a detection logic and processing module 9, which also receives control signals on path G from a timing generator 4. Generally, speaking, the detection logic module 9 functions to provide indicator and/or alarm signals indicative of the presence, within the alternating interrogation field maintained between the respective sides of a given portal, of the desired field-affecting marker member, such indicator or alarm outputs being depicted in FIG. 1 as coupled along a path H to an alarm module which is so marked. Power supply paths are indicated in FIG. 1 as being directed from an outside "power in" source and along a common bus 11 to a power supply 8. The latter provides various power levels and types to the preamp 1, the detection logic module 9, the amp/filter 2, the inhibit amplifier 3, the timing generator 4, the phase driver control 5, and the phase driver 6. The outputs of the phase driver 6 are coupled along the aforementioned paths C and D to portals 1 and 2, to drive the oscillating interrogation coils located there. While state of the art circuits and components which are generally usable as the foregoing functional units are certainly known and available at the present point in time, and are referred to in the aforementioned prior patents, for example, certain preferred new versions or improvements of such are disclosed hereinafter and/or in various co-pending applications; for example, a novel preferred preamplifier and processor are discussed and claimed in co-pending application Ser. No. 358,299, filed Mar. 14, 1982, and a novel preferred inhibit amplifier and processor is discussed and claimed in co-pending application Ser. No. 364,264, filed Apr. 1, 1982.

It should be understood that in accordance with the present invention the interrogation coils at the portals are preferably driven at a nominal oscillation frequency of 10 kHz, and that in order to maximize detection capabilities in a broad sense, it is desirable to drive the two interrogation coils on opposite sides of the same portal in an alternating in-phase and out-of-phase sequence, in "bursts" which continue over a desired number of cycles. Thus, for a first such period both sides of portal 1 and portal 2 will be driven in phase, whereas for the next ensuing such period side 1 of each will be driven with the same phase as before but side 2 of each will be driven with directly out-of-phase excitation, the effect of which will be to re-direct the resultant direction of the interrogation field by 90°, thus affording detection capabilities for particular marker orientations within the field which might possibly be missed or produce very weak detection signals if by chance oriented essentially orthogonal with respect to the direction of flux within the interrogation field. A particular example of a preferred phase-reversal sequencing comprises alternating bursts of 160 cycles (i.e., 16 msec) of the nominal 10 kHz fundamental alternation, separated by a "dead time" or "inter burst gap" of 4 msec, with the first such 160 cycle burst applied with the same phase condition (e.g., "phase A") on both sides 1 and 2 of each portal (i.e., "A-A" phasing), and the second such burst applied with "phase A" on side 1 and the opposite ("phase B") applied to side 2 of each portal (i.e., "A-B" phasing). Accordingly, the antenna at each portal side (constituting the initial "receiving means" herewith) will return in-phase signal components for marker-present conditions within the portal during the first such in-phase drive condition, and out-of-phase marker-present signals during the next such drive condition.

Figure 2:
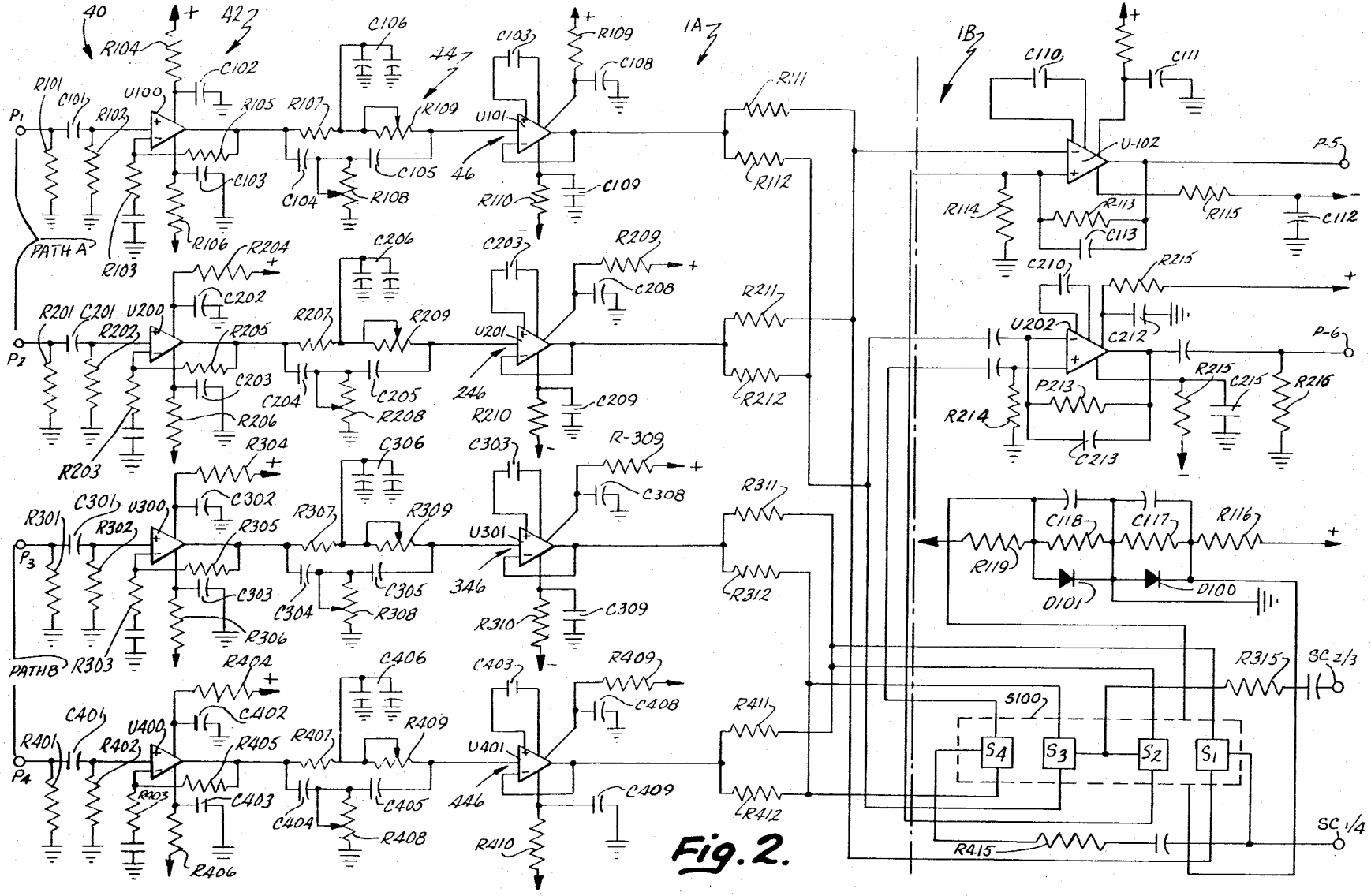
FIG. 2 is an enlarged and schematic circuit diagram of the preamplifier portion of the system shown in FIG. 1.

As indicated in conjunction with FIG. 1, the detection signals from the antennae at the various portal sides are coupled along signals paths A, A′ and B, B′ to the preamplifier 1, a detailed illustration of a preferred embodiment of which is set forth in FIG. 2, to which reference is now made. In the preamp 1, signal paths A and A′ from the receivers, or antennae, which monitor side 1 of both portals 1 and 2, are coupled respectively to preamp inputs P-1 and P-2. Conversely, signal paths B and B′ from side 2 of both portal 1 and portal 2 are coupled, respectively, to preamp inputs P-3 and P-4. As may be observed, each such preamp input feeds into an identically-configured amplifying and filtering network branch, located generally within the circuit portion on the left, designated 1-A, and each of the four such preamplifier/filter network portions feeds into a summation circuit portion on the right, designated 1-B.

Generally speaking, the interrogation field-generating coils are driven, in the alternating-phase sequence noted above, with current pulses on the order of magnitude of approximately 50 amps, preferably once every several cycles of tank circuit oscillation (e.g., every fourth cycle of oscillation), resulting in an oscillation of approximately three hundred volts (peak to peak) in amplitude. Each receiving antenna, therefore, would nominally detect a very strong 10 kHz signal, and for this reason the antennae are preferably figure-eighted in winding configuration, so as to null out as much as possible of the 10 kHz component. The field perturbations caused by the presence within one of the portals of the permalloy strip or other such marker element are miniscule in comparison to the tank drive level, thus presenting very substantial signal-processing difficulties in order to achieve high sensitivity, to avoid missing contraband-carried markers, while at the same time achieving a high degree of selectivity, to avoid erroneous contraband or theft-indicative alarms brought about by any of a variety of metallic objects or articles which also cause perturbations in the interrogation field.

Toward the foregoing end, certain characteristics of marker detection have become known which greatly facilitate the sensitivity-selectivity requirements; for example, the drive excitation pulses applied to the field-inducing coils are highly disruptive in and of themselves, and it is thus desirable to blank out all or part of the receiving circuitry during the time such drive pulses are being applied to the interrogation coil. Furthermore, the actual permalloy or other such low-coercivity markers create field perturbations by switching their magnetic domain orientation each half-cycle of alternation of the interrogation field, i.e., on each positive-going half-cycle as well as upon each negative-going half-cycle, with magnetic domain switching occurring during the first 90° of current flow in the coils for each such half-cycle. Accordingly, if the antenna ("receiver means") signals are examined to determine the presence of a marker within the field only during the current-rise portion of the cycle (i.e., the first 90°), other non-marker perturbations may be screened out. Furthermore, if a sample of the antenna/receiver means signals is examined during other portions of the cycles of interrogation field alternation, i.e., when marker perturbations are not anticipated (i.e., during the current-falling portion of each half-cycle), a representative ambient field condition may be established for comparison with the receiver means signals obtained or examined during those periods when marker signals are to be anticipated if indeed a marker is present within the portal, i.e., within the interrogation field.

In addition to the foregoing, the treatment afforded the receiver means signals prior to actual analysis efforts, whose purpose is to determine whether or not a marker is present, becomes very important to successful processing. That is, while it has heretofore been recognized that the interrogation field fundamental frequency (here, 10 kHz) must be eliminated to the fullest extent possible, the countervailing consideration is to maintain the integrity (fidelity) of the actual signal from the antenna to the greatest extent possible. This desired result is greatly facilitated by the circuit configuration shown in FIG. 2 for the preferred form of preamp 1, in which each separate preamp circuit path proceeding from the different antenna inputds P-1, P-2, etc., is identical, thus making a description of only one such path necessary. Referring to path P-1, it may be seen that the signals first encounter a Pi-type RC filter 40, which applies an initial cut of 6 DB centered upon the 10 kHz drive frequency, but does not introduce any appreciable noise content as other filtering might. Next, the receiver signals encounter an amplifying stage 42, which is preferably a low-noise voltage amplifier having a gain in the order of about ten, designated U100. In a particular preferred embodiment, the latter is implemented by use of an integrated circuit operational amplifier such as that designated as IC5534 coupled into the circuit in the manner indicated, with resistive feedback. Accordingly, the receiver signals from the antennae essentially encounter strong low-noise amplification prior to operational filtering. Such filtering occurs after the first stage of amplification 42, in the twin-T notch filter 44 comprised of resistors R107, R108, R109, and capacitors C104, C105, and C106, in which it will be observed that resistors R108 and R109 are variable in nature, to provide for precise setting of the notch characteristics. Notch filter 44 is centered upon the 10 kHz interrogation field frequency, and supplies at least 40 DB of rejection for such frequency.

Following the notch filter 44 in the preamp circuit paths is a buffer stage of amplification 46, which may be implemented by another integrated circuit No. 5534 operational amp, configured to provide unity gain. It is to be noted that both amplifiers 42 and 46 should be wide band amplifiers, so as to accommodate all of the frequencies within the range extending from the fundamental of the interrogation field out to at least the fifteenth harmonic thereof, while set forth more fully hereinafter, it is to be noted that the high-order and low-order harmonic content of these antennae signals are utilized as important determinative factors in accordance herewith by observing the ratio or relative amounts of these bands of frequencies, at the lower band comprising primarily the third and fifth harmonic range, since this latter range is highly representative of interrogation field perturbations brought about by non-marker metal objects of many and different particular natures. That is, the actual permalloy or like marker produces a significantly different ratio of the higher-order harmonic band with respect to the lower-order harmonic band, even though both the authentic marker and other non-marker objects may produce varying amounts of both frequency bands in the responses detected from the field perturbations which they cause. Indeed, some particular and relatively unusual metal objects (such as certain plated keys and certain loop-form or mesh-type metal objects) may to a considerable degree "mimic" the response of an authentic permalloy or like marker, although in essentially every instance the actual ratio of the high order harmonic band to the low order band (as defined above) will be at least somewhat different than those brought about by the authentic marker element.

Each of the preamp circuit paths commencing at the iinputs P-1, P-2, etc., thus produces a relatively noise-free and significantly amplified version of the antennae/receiver means signals, with the fundamental 10 kHz signal substantially reduced but with harmonics of this signal present. Each such circuit path has a pair of output resistors R111/R112, R211/R212, etc., which are coupled into the summing portion of the preamp 1-B in the following manner. First, it will be noted that the R111-R211 outputs are ganged together and fed to the inverting side of a differential amplifier U102. This same circuit path is coupled to the output side of an upper switch portion S1 in a four-stage CMOS analog switch S100, through which signals from preamp path P-3 output resistors R311 and R411 may also be coupled, upon appropriate actuation (excitation) of switch control terminal $SC_{\frac{1}{4}}$, which also controls switch stage $S_4$ of the CMOS switch S100.

Output resistors R112 and R212 in preamp paths P-1 and P-2 are ganged together and coupled to the inverting input of a second differential amplifier U202, and that signal path is also coupled to the output side of a third switch stage $S_3$ of switch S100. Similarly, output resistors R312 and R412 of preamp paths P-3 and P-4 are ganged together and coupled to the input side of switch stage $S_3$ in switch S100. These same two output resistors, R312 and R412, are also coupled to the input of the fourth switch stage, $S_4$, of the CMOS switch S100, just as output resistors R311 and R411 are additionally commonly-coupled to the input side of the second switch stage, $S_2$, of switch S100.

From the foregoing, it may be seen that the output of commonly-coupled, preamp paths P-1 and P-2, which represent side 1 of both portals 1 and 2 (FIG. 1), are coupled to the inverting (i.e., "−") side of both differential amplifiers U102 and U202, and that signals from preamp paths P-3 and P-4, representing side 2 of both portals 1 and 2, will also be applied to this same side of differential amplifiers U102 and U202 (as outputs from resistors R311 and R411) when either the first stage ($S_1$) or the third stage ($S_3$) of switch S100 are actuated, through energization of their respective different control terminals (i.e., $SC_{\frac{1}{4}}$ or $SC_{\frac{2}{3}}$). At the same time, the non-inverting (i.e., "+") side of differential amplifier U102 is coupled to receive the outputs from side 2 of portals 1 and 2 (preamp paths P-3 and P-4, from resistors R311 and R411) whenever the second switch stage ($S_2$) of switch S100 is triggered by a signal on switch control terminal $SC_{\frac{2}{3}}$, and the analogous (non-inverting) side of differential amplifier U202 will receive the side 2 (paths P-3 and P-4) output signals (from resistors R312 and R412) upon actuation of the fourth stage ($S_4$) of switch S100, by an appropriate signal on switch terminal $SC_{\frac{1}{4}}$. For purposes of this specification, these control signals applied to switch terminals $SC_{\frac{1}{4}}$ and $SC_{\frac{2}{3}}$ may merely be considered as comprising appropriately-timed gating signals produced by the timing generator 4 of FIG. 1 which are closely synchronized to the oscillations of the L-C drive circuits for the interrogation field, as referred to elsewhere herein.

Accordingly, by supplying the aforementioned gating signals to the switch terminals of CMOS switch S100, the antenna signals from the opposite sides of the two portals will be constructively summed (magnitudes instantaneously added) in one path and conversely, "destructively summed" or differenced in another path, to provide two quite different but nonetheless related signal outputs on preamp output terminals P-5 and P-6, leading from differential amplifiers U102 and U202, respectively. More particularly, when both sides of each portal are being driven in-phase with one another, the outputs from their respectively-associated antennae are in phase and are directly added (summed) by operation of the first switch stage $S_1$ of switch S100, an appropriate control signal being suppled at that time to control terminal $SC_{\frac{1}{4}}$. Under these conditions, differential amplifier U102 has all four such amplified, in-phase antenna signals applied to its inverting input, and none applied to its non-inverting input. The control signal applied to terminal $SC_{\frac{1}{4}}$ also actuates the fourth switch stage, $S_4$, thus applying the very same output signal from paths P-3 and P-4 to the second differential amplifier, U202, but in the reverse manner, i.e., applying such signals to the non-inverting inputs, whereas the other two antenna signals are applied to the inverting inputs, so that these two sets of signals are differenced, or subtracted, at differential amplifier U202.

When the opposite phase relationship occurs at the interrogation fields (i.e., side 2 of both portals driven out-of-phase with side 1 thereof), a similar end result is obtained through opposite switching of the analog switch S100. That is, additive summation occurs at differential amplifier U102 and subtractive summation at amplifier U-202, i.e., signals from side 2 of both portals are arithmetically added together at amplifier U102 (directly out-of-phase signals applied to opposite inputs of the differential amplifier) while the same signals are arithmetically subtracted at amplifier U202 (i.e., directly out-of-phase signals resistively combined and applied to the inverting input, and no signal applied to the non-inverting input). Accordingly, the output appearing at preamp output terminal P-5 represents the algebraic difference but arithmetic sum, of the antenna signals from sides 1 and 2 of the two portals, whereas the output at preamp terminal P-6 represents the algebraic summation but arithmetic difference of the antenna signals from opposite portal sides, taking into effect the alternating phase conditions present within the interrogation field. In this connection, it is to be noted that the control signals applied to terminals $SC_{\frac{1}{4}}$ and $SC_{\frac{2}{3}}$ and the CMOS switch S100 are preferably of sufficient duration to maintain switch actuation throughout the entire time interval from the initiation of one phase condition (for example, A-A) to the initiation of the next succeeding phase condition (continuing the example A-B). That is, the "on" time for the switch should preferably continue through the aforementioned dead space or interburst gap, rather than ending at the immediate conclusion of the ongoing phase condition, since by continuing the summing and differencing operation on into the "dead space", additional signal information will be obtained with respect to interrogation field perturbations which will contribute meaningfully to system sensitivity and selectivity.

Quite clearly, the two signals appearing on preamp output terminals P-5 and P-6 will have substantially different characteristics, the first such output representing combined antenna outputs providing the highest possible signal-to-noise characteristics, for maximum sensitivity, whereas the output on the second such terminal has had eliminated from it "common-mode" noise and other such undesired frequency components. The first aspect is particularly important with respect to the weakest likely marker-present conditions, i.e., a marker whose particular metallurgy and/or physical characteristics produce very weak perturbations of the interrogation field, and which is located in the middle of the portal, midway between the two sides where the receiver means antennae are located: a set of conditions likely to be missed in prior systems. Of course, by use of a separate preamp circuit or path for each portal side receiver, i.e., antenna, sensitivity is optimized in any event, and even this basic factor has been lost upon certain of the prior systems; this is all the more true when the particular preamp circuit path configuration, as described above, is taken into consideration, since this optimizes the desired signal (i.e., harmonic frequency bands) with the least introduction of noise. Of course, the summing (additive and subtractive) described above is a further and very substantial enhancement for systems such as those in use or proposed heretofore.

Some of the reasons underlying the above-described differencing of the common-mode noise signals from the two different sides of a single portal result from the fact that, in contrast to the true or real (e.g., permalloy) marker, most other objects or materials which would have a low enough coercivity to generate harmonics of interest (i.e., tending to mimic or mask a true marker) also have low permeability and only cause a perturbation in the interrogation field when in close proximity to the portal sides, i.e., to an interrogation field-generating coil or to an antenna or receiver. Thus, a non-marker object carried through a portal causes a perturbation in the field as the object passes near the interrogation coil. At the same time, there are many objects or structures which may be present beneath the floor, for example, wire mesh, concrete reinforcing rods, etc. . . , or in the ceiling (e.g., ceiling grids) which cause receiver signals in the 30 to 50 kHz region, i.e., the third and fifth harmonic of the 10 kHz drive frequency fundamental. Additionally, even distortion in the capacitor geometry and the coil geometry of the L-C field drive circuit are likely, due to the high magnetic flux densities, to produce receiver signals in the 30 to 50 kHz region. It is desirable to lower this background or ambient noise level, so that field perturbations caused by non-marker items passing through the portals very near the interrogation field coil at one side would have the greatest detectable effect, i.e., would be more easily and more reliably detected, and thus discriminated out of alarm-causing effect.

To this end, the receiver (antennae) signals from opposite sides of the same portal are "summed" (i.e., combined) in accordance herewith such that during each particular interrogation field phase condition such signals are arithmetically subtracted from one another, or differenced, that is, they will (at least partially) cancel out one another. The signals coming from the two antenna are much alike, and if the two signals, properly phased, are summed together so that one cancels with the other, the result will be to lower the signal portion attributable to "background" or environmental noise, thereby enhancing, or highlighting, pertubation effects from objects located near one portal side. On the other hand, a true marker causes a significant perturbation even as it passes down the center of a portal, and it is desirable to enhance those perturbation effects. To accomplish such enhancement, the antenna signals from opposite sides of the same portal are constructively (algebraically) added in the preamp and processor to produce a differently-constituted second composite or resultant signal from subsequently processing, containing all of the perturbation effects present at either antenna and therefore maximizing the result produced by a real marker.

Thus, the present invention provides an appreciation and realization that the only time a non-marker object is likely to produce perturbations with a harmonic response fairly closely resembling that caused by an actual marker is when the object is close to one of the portal sides. That is, because of the comparatively low permeability of most non-marker objects, they do not have as large an affect on the interrogation field as the permalloy strip of a true marker does, and so only generate significant harmonics when interrogated with a very strong field. When so interrogated, a non-marker may actually generate some of the same harmonics as a marker, but not to the same extent, and not in the same ratio of harmonic orders, and non-marker objects will thus be detected to a greater extent when the object is close to one portal side. It is important to realize, moreover, that perturbations caused by non-markers do not have the same distribution or ratio of harmonics, and that is why it is desirable to produce, and compare, the two different preamp output signals, as done in accordance herewith. Furthermore, while a non-marker will theoretically produce the same distribution of harmonics, or the same harmonic content, whether it is in the middle of a portal or close to one side, the permeability of such an object is likely to be such that its magnetic domains do not even undergo switching by the interrogation field if the object is near the center of the field, whereas a true marker will still undergo substantial saturation and domain-switching under such circumstances. That is, the strength of the interrogation field does differ across its width, but the perturbation effect of any object is really a function of two factors: first, coercivity, which for non-markers is most likely not as low as that of the real marker, requiring a stronger field to cause domain-switching; second, non-marker objects do not have as high a permeability as real markers, and non-marker objects do not disrupt the field as much when they do undergo switching. Thus, there is a double effect as an object moves away from a side of the portal, and the effects caused by non-markers fade away very quickly.

The above-described separate outputs from preamp terminals P-6 and P-5 are separately and respectively applied to the inhibit amplifier 3 and the amplifier/filter 2 noted above in connection with FIG. 1, where each such output is separately processed (basically, amplified and frequency-shaped), and the resulting outputs are then separately supplied to the detection logic and processing unit 9.

Figure 3:
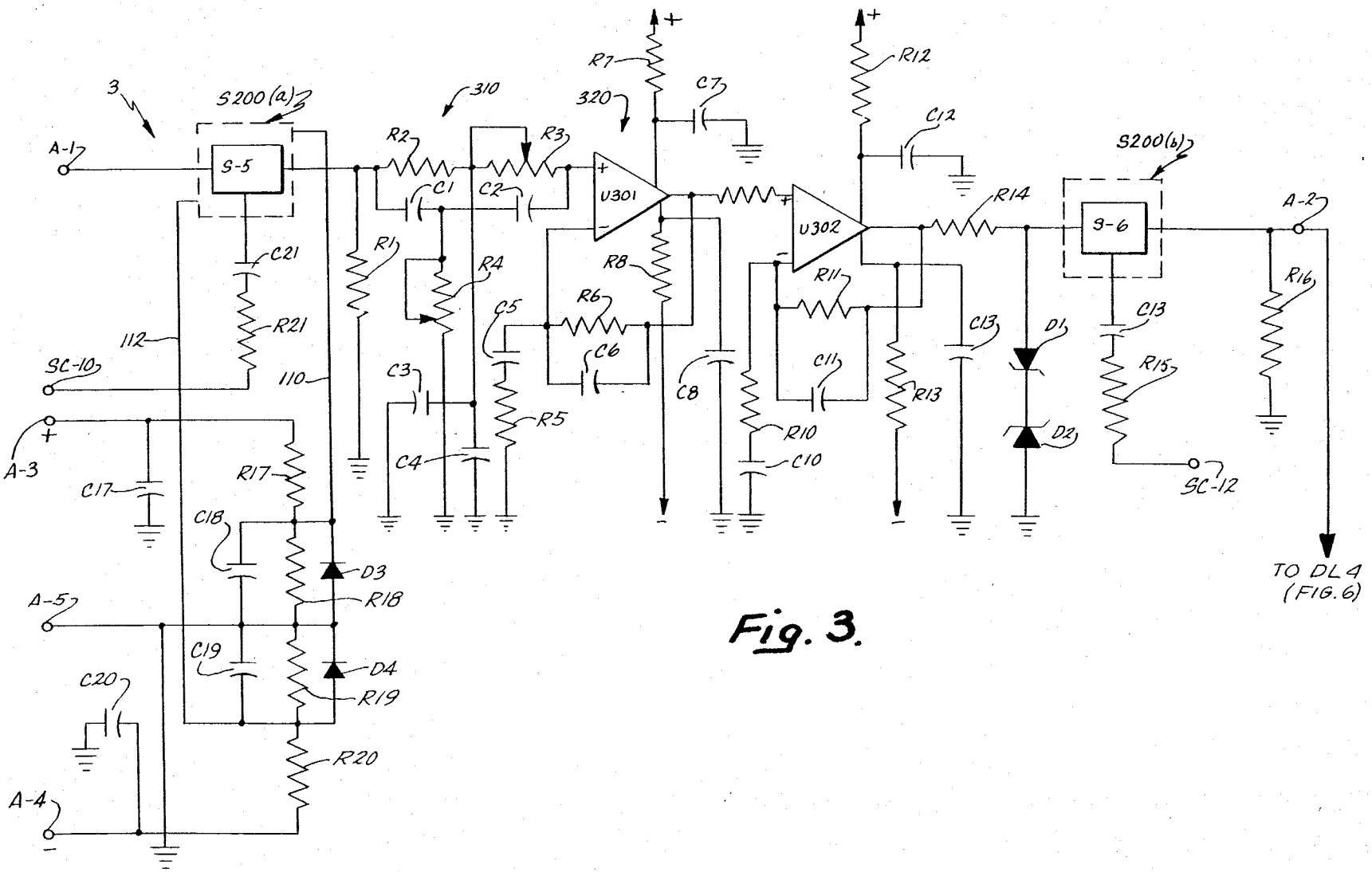
FIG. 3 is an enlarged schematic circuit diagram of the inhibit amplifier portion of the system shown in FIG. 1.

More particularly, the output signal from preamp terminal P-6 is applied to input terminal A-1 of the inhibit amplifier 3, a preferred embodiment of which is illustrated for convenience in FIG. 3, and is the subject matter of my co-pending application Ser. No. 364,264, filed Apr. 1, 1982. Basically, inhibit amplifier 3 is preferably a two-stage band pass amplifier whose pass band encompasses primarily the third and fifth harmonic, and preferably the seventh as well, of the alternating interrogation field frequency (in the preferred embodiment already noted, 30 to 50, and up to about 70 kHz), which generally characterizes the lower frequency spectrum in the ratio used to critically identify the particular marker element within the interrogation field, as explained more fully hereinafter. It will be noted that both the input terminal A-1 and the output terminal A-2 are subject to switching by being coupled through the complementary halves of a CMOS analog switch S200, which may advantageously be implemented by a single four-stage such switch, the two complementary halves of which are shown for purposes of illustration at different positions in FIG. 3 (i.e., one at the input and one at the output). Additionally, the input terminal A-1, after being switched through switch portion $S_5$ of CMOS switch S200 (a), is coupled to a twin T-notch filter 310 preferably having a variable resistance in both its series-connected and parallel-connected branches. Like the twin-T notch filter 44 noted above in connection with the preamp 1, notch filter 310 is used for the purpose of further removing, i.e., diminishing, the 10 kHz fundamental frequency of the interrogation field, since the effects of the latter are very strongly present in the receiver signals picked up by the various antennae, and require substantial effort to properly filter out for optimum sensitivity and selectivity in marker detection. By the variable-resistance twin-T filtering concept noted, another 40 DB of rejection in the residual level of the 10 kHz signal may be accomplished, with desirable results.

As noted, the input to the inhibit amplifier 3, and the output from such amplifier and circuit, are both subject to switching by the analog switch S200. This switching is provided for blanking purposes, during which the inhibit amplifier may be effectively removed from operation at certain critical points in the operation of the system, i.e., when the interrogation field-generating coils are receiving their drive pulses. Such blanking is accomplished by appropriately timed inputs on CMOS switch control terminals SC10 and SC12, the first of which blanks the input and the second of which blanks the output. Signals for these two control terminals are provided from the timing generator 4 noted in connection with FIG. 1, and may generally be considered as blanking pulses whose width determines the time of circuit shutdown, the timing of the blanking signals being synchronized to the application of the aforementioned excitation or drive to the field-producing coils. In a more particular sense, the blanking signal applied to control terminal SC12, at the output of the inhibit amplifier, is preferably about 50% longer in duration than the signal applied to switch control terminal SC10, which blanks the input of this amplifier. In a particular sense, where the interrogation field fundamental frequency is 10 kHz and one quarter-cycle (during which time the drive pulse is actually applied) has a duration of 25 microseconds, a preferred input blanking period is on the order of 100 microseconds, and a preferred output blanking period is 150 microseconds, both signals synchronized to the drive pulse. By so doing, transients produced in the amplifier as a result of switching will have been avoided, and both the amplifier and the LC oscillating circuit will have undergone substantially complete settling, thus avoiding distortion effects which can be very significant.

The output from the inhibit amplifier 3 comprises carefully-timed bursts of the frequency range representing primarily the third and fifth harmonic of the interrogation field fundamental, as noted above, and this output from terminal A2 of the inhibit amplifier is applied to input terminal DL-4 of the detector logic circuit 9 (FIGS. 4, 5 and 6), to be described further hereinafter.

The second output from the preamp 1, namely that appearing on its output terminal P-5, is applied to the amplifier/filter 2, noted previously in connection with FIG. 1. Preferably, the amp/filter 2 is a three-stage band-pass device, having a single-ended output which is directed to the detector logic circuit 9. With respect to the preferred characteristics of the amp/filter 2, three stages of amplification are preferred, which may all be implemented by use of an LM-318 integrated circuit operational amplifier, connected in a multiple-pole amplifying configuration with appropriate frequency-shaping capacitance, centered upon the desired pass band comprising the fifteenth harmonic of the fundamental frequency at which the interrogation field is driven, in the embodiment contemplated here approximately 140 kHz. In the preferred configuration, the first stage is a high pass stage, the second stage is a band-pass stage, and the third stage is essentially a gain stage with both high and low cuts. Where integrated circuit amplifier stages are used in the manner contemplated, the succeeding stages are preferably coupled in complementary conductance configuration, with appropriate positive-negative-positive reference or biasing voltages. As already indicated, the output from amplifier/filter unit 2 is coupled to the detector logic network 9, where it is inputted on terminal DL-1.

Figure 4:
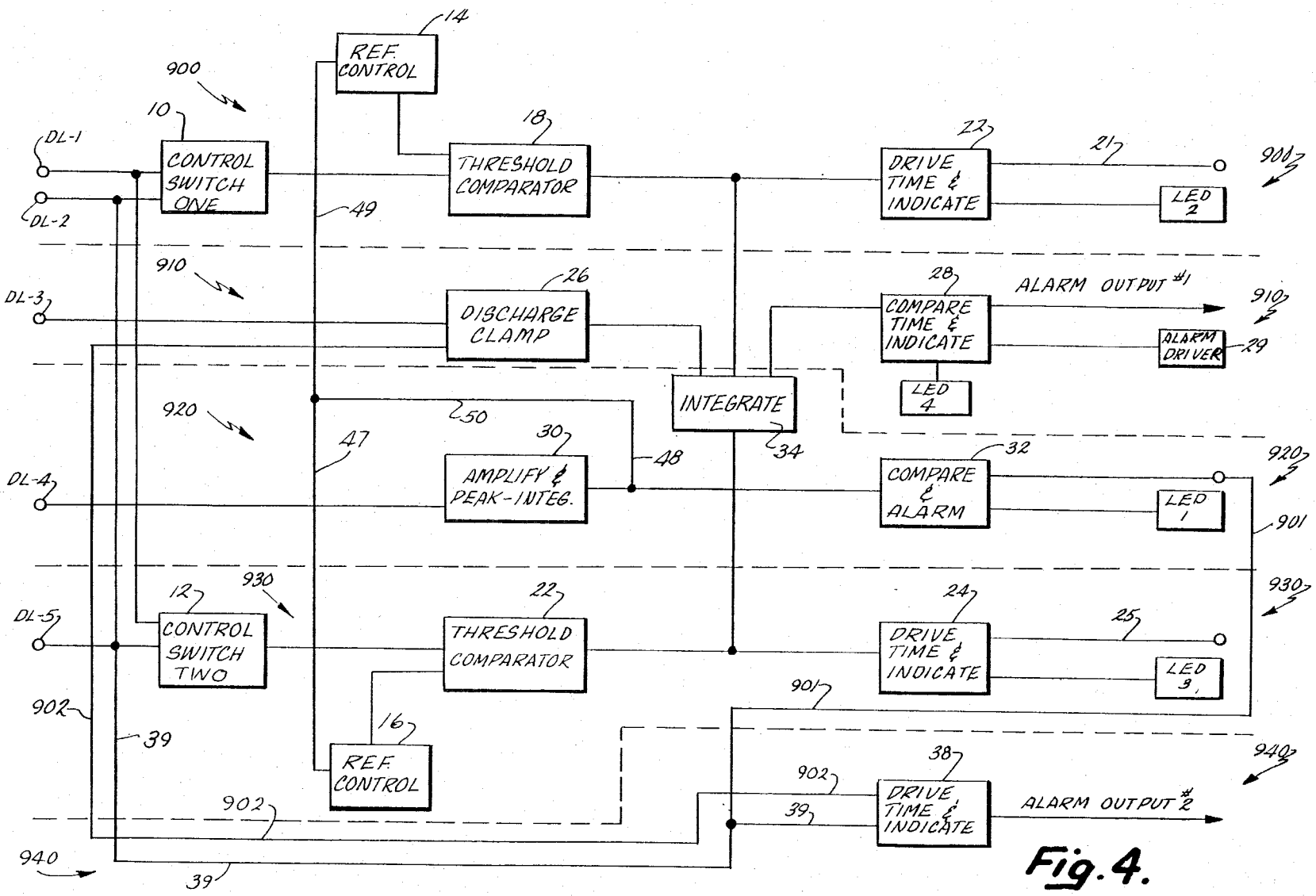
FIG. 4 is an enlarged, simplified system block diagram illustrating the preferred detection logic and processing circuitry.

Referring now to the detection logic network 9, and initially to FIG. 4 which illustrates the general nature of a preferred form thereof, it will be observed that this system has five discernable branches, designated by the numerals 900, 910, 920, 930, and 940, which are set apart from one another in this figure by dashed lines, for purposes of illustration. Of these, branches or sectors 900 and 930 are essentially the same as one another from the standpoint of componentry, although having very definite operational differences to be noted subsequently. That is, both branches 900 and 930 embody a control switch 10, 12, respectively, a reference control and threshold comparator set 14, 18 and 16, 22, respectively, and a driver timer, and indicator unit or circuit portion 22 and 24, respectively each of the latter having respective output terminals 21 and 25 as well as LED signal elements ("LED 2" and "LED 3", respectively). As further seen in FIG. 4, the respective outputs from the threshold comparators 18 and 22 are also directed to an integrator 34, and thus are seen to be summed with respect to one another; however, the particular manner in which such summing is carried out is an important aspect and is described in much greater detail hereinafter.

With continuing reference to the block diagram of FIG. 4, and to the general attributes of detector logic unit 9, the center circuit portion 920 includes an amplifying and integrating, or integrating-detector, circuit portion 30, which receives an input from terminal DL-4 (i.e., the output from the inhibit amplifier 3) and has an output directed to a comparator and alarm 32 having an LED indicator ("LED 1") as one of its outputs. The output from this alarm is also fed as an input to the lower circuit branch 940, more particularly, to a driver, timer and alarm unit 38, which as indicated provides an "Alarm Output No. 2". This same input terminal of the alarm unit 38 receives control signals on an input lead 39 connecting to the "signal gate" and "noise gate" inputs fed to control switches 10 and 12 from circuit input terminals DL-2 and DL-5. The second (upper) input terminal of the driver, timer and alarm unit 38 is coupled back to the input side of a discharge clamp 26 in path 910, whose primary input is from circuit terminal DL-3. The output of the discharge clamp 26 is coupled to, and directly affects, the integrator 34, and the integrator is coupled to, and actuates, a comparator, timer and alarm 28 having a primary alarm output directed to a lamp driver 29, which also provides a switched alarm output, labeled Alarm Output #1. Also, timer and alarm 28 controls an indicator LED ("LED 4") coupled to its output.

Figure 5:
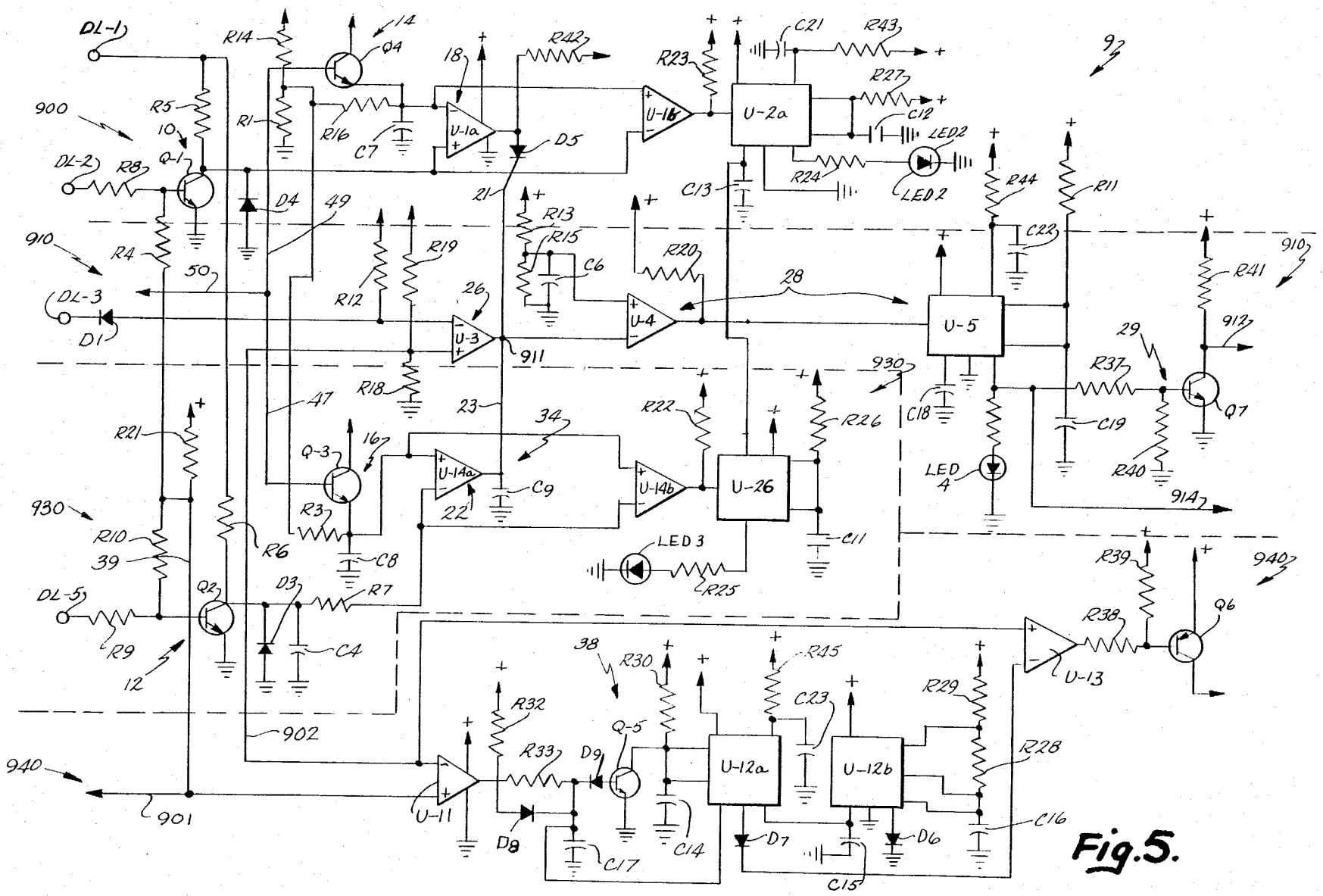
FIG. 5 is a schematic circuit diagram showing a first portion of the detection logic and processing circuitry of FIG. 4.
Figure 6:
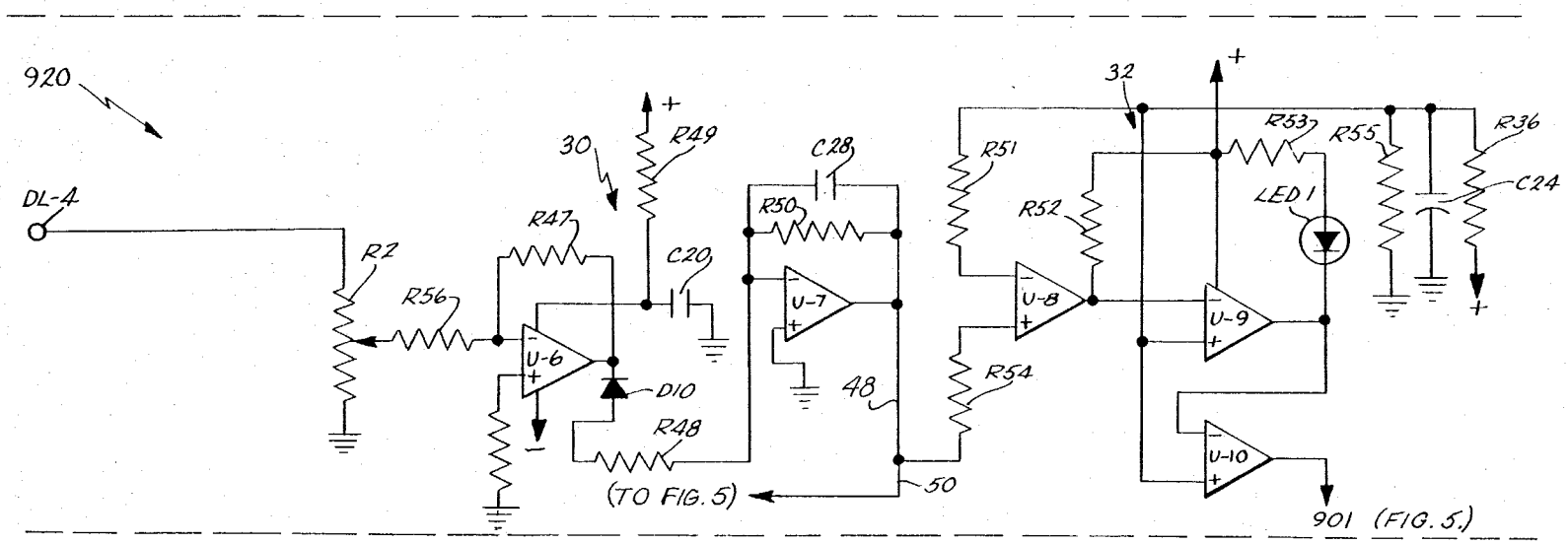
FIG. 6 is a schematic circuit diagram showing the second portion of the detection logic and processing circuitry of FIG. 4.

Referring now in more detail to the detector logic circuitry as depicted in FIGS. 5 and 6, it will first be noted that the upper and lower portions of the circuit, comprising channels 900, 910, 930 and 940 in FIG. 4, are depicted in FIG. 5, whereas the central portion of the circuit, comprising the path designated by the numeral 920 in FIG. 4, is depicted separately in FIG. 6. In the preferred embodiment shown in these figures, the elements identified as "control switch one" and "control switch two" in FIG. 4, and designated by the numerals 10 and 12 therein, are shown to comprise input switching transistors Q1 and Q2, whose bases receive control inputs through resistors R8 and R9, respectively, from circuit input terminals DS-2 and DL-5. Also, the bases of switching transistors Q1 and Q2 are coupled together through resistors R4 and R10, and the junction of the latter two resistors is coupled to the low voltage side of a pull-up resistor R21, and then through conductor 39 to the positive or non-inverting side of an amplifier U11 in path 940. The primary signal inputs to be switched by transistors Q1 and Q2 are received on circuit input terminal DL-1, which is coupled to the collector of each such transistor through resistors R5 and R6, respectively.

The "reference control" components or units 14 and 16 of FIG. 4 are seen in FIG. 5 to comprise switches, e.g. transistors, Q4 and Q3, respectively, which are connected in emitter-follower configuration, and whose bases are coupled together by leads 47 and 49 so as to receive a common input from conductor 50 (also seen in FIG. 4), to be described subsequently. The respective outputs from transistors Q4 and Q3 are coupled as reference inputs to threshold comparators U-1*a* and U-14*a*, and it is to be noted that the circuit arrangement of paths 900 and 930 is of an inverted configuration, i.e., the output from transistor Q4 in path 900 is applied as an inverting input to comparator U-1*a*, whereas the output from transistor Q3 in path 930 is applied to the non-inverting input of comparator U-14*a*. Each such comparator input also receives a particularly-set reference voltage obtained from the junction of voltage-divider resistors R14 and R1, and applied through input resistances R16 and R3, respectively. The respective opposite input terminals of threshold comparators U-1*a* and U-14*a* receive inputs from the collectors of switching transistors Q1 and Q2, respectively. These inputs are also supplied to comparators U-1*b* and U-14*b* (which may be half of the same double integrated circuit amplifier comprising comparators U-1*a* and U-14*a*, respectively, for example, an integrated circuit comparator No. 339). In essence, the second comparators U-1*b* and U-14*b* are used as drivers for ensuing timers and indicators U-2*a* and U-2*b*, whose primary function is merely to time out or "stretch" an indicator drive signal of desired duration on respective signal lamps LED 2 and LED 3, as described hereinafter. As indicated, the two timers U-2*a* and U-2*b* are interconnected to one another, and they may in fact be implemented as the complementary halves of an IC556 timer, which is a double unit.

The lowermost circuit portion 940 of the detector logic network 9 comprises in effect a comparator, a current source which drives a ganged double-timer, and an amplified lamp-driver output for alarm signal purposes. More particularly, the initial comparator comprises the aforementioned comparator unit U-11, which may be implemented by use of a 339 integrated circuit component. The comparator output is diode-coupled to a transistor Q5 disposed in grounded-collector configuration to act as a timed current source whose timing cycle is determined by the charge rate on capacitor C14. This current source drives the double-timer U-12*a* and U-12*b*, which may advantageously be the two halves of a No. 556 integrated circuit timer whose terminals are ganged in the manner illustrated. The first half of the timer, U-12*a*, is diode-coupled (D7) to a final amplifier or driver U-13 and lamp driver Q6, driver U-13 being a further comparator component which may be implemented by use of a 339 IC whose non-inverting input is supplied by the same signal which is applied to the inverting side of the first-stage amplifier U-11. Further, the first timer stage U-12*a* is connected to (diode OR'd with) the second timer stage U-12*b* such that the first stage, upon its initial excitation, immediately commences a continuous lamp-driving operation of amplifier U-13 and switch Q6, as a "power on" indicator; however, whenever the current source comprising transistor Q5 and its timing capacitor C14 reaches full charge, the second timer (U-12*b*) is gated in and assumes control of the output signal, causing a blinking of the signal lamp driven by driver Q6, for purposes noted subsequently.

Generally speaking, the operation of that portion of the detector logic circuitry described above is a follows. Input terminal DL-1 receives the above-described output from the amp/filter 2, which as already pointed out comprises the arithmetically-summed antenna signals from both sides of a given portal, or group of portals, after band-pass amplification centered upon the fifteenth harmonic of the interrogation field fundamental frequency. This signal is supplied equally to the control switches Q1 and Q2, whose switching operation determines whether or not any portion of the supplied signal is gated through the switching transistors to either path 900 or path 930. The latter two channels are gated into and out of operation by timing signals applied to inputs DL-2 and DL-5, as supplied from the timing generator 4. The first such input, to transistor Q1, is representative of the "signal gate" or "marker signal window", i.e., those particular increments of time representing an increasing-current condition (both positive-going and negative-going) in the interrogation field drive coils; consequently, these gate signals represent times when a marker-present signal is likely to be present in the signals from the portal antennae, if a marker is in fact present within the interrogation field. Conversely, the gating signals applied to terminal DL-5 and transistor Q2 represent the opposite portion of the interrogation field alternations, i.e., when marker-present signals are not likely to occur in the antennae signals even if a marker is present in the portal. Consequently, the gate signals applied to terminal DL-5 define a "noise gate", i.e., a period of time during which the signals received by the portal antennae, on an instantaneous basis, represent an actual measure of the existing noise level in the antennae signals.

It should be noted that, in accordance with this invention, the duration of the aforementioned "noise gate" is shorter than the duration of the "signal gate", and that there is a gap or interval between the two. More particularly, assuming the interrogation field fundamental frequency to be 10 kHz, so that the duration of each quarter-cycle is 25 microseconds, the marker-present signals are likely to occur during the quarter-cycles when the current is increasing, either positively or negatively, whereas the current-decreasing quarter-cycles represent the condition when marker-present signals are not likely to occur in the antennae signals. By maintaining the "signal gate" for a full 25 microseconds but maintaining the "noise gate" for only approximately half that time, thus providing a gap of approximately 12 microseconds between each noise gate and ensuing signal gate, distortion and transients which otherwise would "ring through" the circuit will be eliminated, thus further enhancing sensitivity and reliability. Of course, the particular timing and synchronization of such signals are also highly important, however, the general state of the art includes timing circuits and components well able to provide satisfactory gating or blanking signals of this type.

Since the inputs to terminals DL-2 and DL-5 occur at different points in time, and in effect represent an alternating sequence, circuit paths 900 and 930 of the detector logic 9 in effect alternate in operation, and during the period each is in operation it applies an input to the aforementioned threshold comparators U-1*a* (and U-1*b*) (in channel 900) and U-14*a* (and U-14*b*) (in channel 930). In so doing, each such circuit path functions to alter the charge state of an integrating capacitor C9, and it is important to note that the two circuit paths act oppositely from one another in that regard. That is, the switched input from transistor Q1 to comparator U-1*a* in path 900 is applied to the non-inverting (i.e., positive) input, whereas the opposite is true in path 930, where the signals gated through by switch Q2 are applied to the inverting side of comparator U-14*a*. Consequently, the two such circuit paths act to rapidly and sequentially apply increments of charge to, and draw increments of charge from, integrating capacitor C9, on an alternating, increment-by-increment or pulse-by-pulse basis. As will be seen hereinafter, these added and subtracted increments of charge are not necessarily equal in magnitude, and the resultant charge state on the integrating capacitor is thus cumulative with respect to time during each "burst" of pulses, so long as they are of the same phase, as described more fully hereinafter.

It is very important to note, in conjunction with the alternating operation of circuit paths 900 and 930 noted just above, that the signals gated through by transistors Q1 and Q2 to comparators U-1*a* and U-14*a* work against variable reference levels, and that these variable reference levels are applied to the opposite-polarity input terminal of each such comparator. That is, in circuit path 900 the inverting input of comparator U-1*a* receives the variable reference level, whereas in circuit path 930 it is the non-inverting input of comparator U-14*a* which receives the other such variable reference level. As already indicated above, these variable reference levels both operate from the same nominal or steady-state reference level, obtained from the junction of voltage-divider resistors R14 and R1, through identical series resistors R16 and R3. This steady-state reference level is subject to variation, however, by the operation of transistors Q4 and Q3, which constitute the "reference controls" 14 and 16 noted in connection with FIG. 4. That is, in channel 900 the base of transistor Q4 is controlled, in a manner described more particularly hereinafter, so as to vary the resulting reference level applied to the inverting terminal of differential amplifier U-1*a*. In channel 930, the steady-state reference level is applied to the non-inverting input of comparator U-14*a*, and this nominal reference level is made subject to variation by reference control 16, i.e., transistor switch Q3, which receives the same varying input as transistor Q4, i.e., the base of each of these transistors is commonly coupled to receive the same control input signal (from the output of the amplifier, peak-detector and integrator 30 in path 930, shown in FIG. 5). In the case of both circuit paths 900 and 930, the second-stage comparators U-1*b* and U-14*b*, respectively, may be considered as in essence duplicative of the first such stage, insofar as inputs are concerned, except that instead of applying and subtracting charge from integrating capacitor C9, they are utilized to drive indicators LED 2 and LED 3, which are pulsed by timer units U-2*a* and U-2*b*, to indicate the operational status of each such circuit path.

The second portion or channel 910 of the detector logic network 9 is also illustrated in detail in FIG. 5, and will be seen to include a pair of inputs, a first one of which is provided by circuit input terminal DL-3 which is coupled to the inverting input of a comparator U-3, comprising the "discharge clamp" 26 noted in connection with FIG. 4. The output of this comparator connects to the conductors 21 and 23 by which charge is applied to and removed from integrating capacitor C9. Therefore, when an appropriate gating signal is applied to the inverting side of comparator U-3, under general system conditions to be noted subsequently, this comparator/amplifier will clamp integrating capacitor C9 to ground, thus fully discharging the integrator. This in effect terminates, and dissipates, the incrementally-accumulated charge effect carried on for the duration of each different phase condition present in the interrogation field, as noted above. Therefore, each time the interrogation field-inducing coils are to be switched from one phase condition to another (for example, from an in-phase or phase A-A condition to an out-of-phase, or phase A-B condition), an appropriate pulse supplied from the timing generator 4 is applied to input terminal DL-3, to fully discharge the integrating capacitor C9. During the time each opposite phase condition exists (described previously as preferably on the order of 16 msec, representing 160 cycles of alternation) the charge state existing on integrating capacitor C9 is continuously subject to pulse-by-pulse change, depending upon the operational levels of circuit paths 900 and 930, described above.

An important function of the detection logic and processor 9, involving that portion thereof designated generally as channel 910, and particularly of that portion of the circuitry disposed to the right of portal point 911, is the production of a desired alarm or signal upon the detected presence of the particular marker within the interrogation field. More particularly, it will be noted that the node or junction 91 where comparator U-3 interconnects with conductors 21 and 23, which lead to the integration capacitor C9, comprises the signal input to a comparator U-4, which receives a predetermined bias or steady-state reference on its positive (non-inverting) input terminal from voltage-divider resistors R13 and R15. Therefore, at any time the charge level on integrating capacitor C9, representing the relative proportions of higher-order harmonic content in the antenna signals versus lower-order harmonic content therein, caused by an object producing perturbation of the interrogation field, rises to a predetermined level, established by the reference applied to comparator U-4, this comparator triggers and applies an alarm-causing output signal to the timer U-5 (which may be an IC No. 555). One output of timer U-5 actuates an alarm signal (LED 4) and is also coupled to an output driver Q7, which may be used to drive signal lamp, sound an audible alarm, or the like, utilizing an output taken at terminal 912 connected to the collector of transistor Q7. Further, a switched output signal of timer U-5 which is representative of the control signal applied to the base of transistor Q7 is available on the output terminal designated 914.

Perhaps the most important of the many important functions of the detection logic and processing network or unit 9, is carried out on circuit path 910, shown in more detail in FIg. 6. As shown there, this circuit path receives an input on terminal DL-4, which input comprises the amplified, frequency-selective output from the inhibit amplifier 3, noted generally in connection with FIG. 1 and more particularly in the aforementioned copending application Ser. No. 364,264, filed Apr. 1, 1982. This signal comprises sequential, time-gated, synchronized bursts of the subtracted (differenced) signals from the portal antennae, after low-pass selective amplification thereof in the inhibit amplifier 3. Consequently, this input is representative of the low-frequency component band (in the range of the third, fifth, and perhaps the seventh harmonics of the interrogation field, here on the order of 30 to 50, and approaching 70, kHz), which signal is attributable to an object within the interrogation field. Whether that object is an actual marker, or merely some nonmarker element causing perturbations in the interrogation field, remains to be determined, but as already indicated, the true or actual markers will have a relatively unique ratio or balance of the high frequency component band with respect to the low frequency band. This low frequency band is used in the detection logic and processing unit 9 as a determinant which must be satisfied by the magnitude of the high frequency band produced by the same object within the interrogation field before a marker-present signal or alarm is sounded; i.e., the amount (magnitude) of the low frequency band actually encountered, as represented by the magnitude of the input applied to terminal DL-4, is used to determine the required level which the high frequency band produced by the same object in the field must equal or exceed if it is indeed an actual marker; the ratio or balance of these frequency components for true markers being relatively unique.

To achieve the above result, the aforementioned input on terminal DL-4 is coupled to one end of a variable resistance or potentiometer R2, whose wiper is coupled through a series resistor R56 to the inverting input of a differential amplifier U-6 coupled into the circuit as an inverting amplifier, whose gain is thus set by potentiometer R2. Inverting amplifier U-6 (which is preferably implemented by use of a 3240 integrated circuit operational amplifier) forms part of the amplifier, detector and integrator unit 30 noted briefly above in connection with FIG. 4; thus, the output of inverting amplifier U-6 is diode-coupled through a series resistor R48 to the parallel combination of a second inverting amplifier U-7 and an R-C integrating network consisting of resistor R50 and capacitor C28. This overall network in effect comprises a combination amplifier, peak-detector and integrator, or in effect an integrating detector. That is, the charging time-constant for capacitor C28 is a function of the voltage drop across series resistor R48. Thus, the charge on capacitor C28 will build during the continuation of each burst of input signals applied to terminal DL-4 and passed by inverting amplifier U-6, with capacitor C28 integrating only the peaks of the negative excursions of the incoming signals (i.e., that portion of a cycle which exceeds the preset reference level).

The peak-integration or integrating-detector effect just noted is preferably accomplished by maintaining the integration time constant or capacitor C28 of very short duration, for example by utilizing a 0.1 microfarad capacitor for C28 and a 4.6 K-ohm resistor for R48. This will produce a very fast-acting integrator which will operate in the manner of a current source, i.e., integrating for only the first few excursions and tracking the applied signal very accurately and closely, yet reducing the effects of narrow, high-amplitude spikes due to switching transients from the blanking (gate-generating) and other releated circuitry. This type of detector is preferred since the band-pass stages preceding it allow some of the higher order components (for example in the range of 140 kHz) to pass through, usually in the form of spikes. Additionally, spikes may be created by the blanking circuitry, as just indicated. If a more conventional peak-detector was used, such spikes would result in a high level of detected signal, whereas the preferred integrating detector responds more to the average value above the diode (D-10) voltage drop. The level of the signal so integrated appears on conductor 48 (FIG. 6), on the output side of inverting amplifier U-7, and this signal level is not only coupled forward to a comparator U-8, but is also reflected back (on conductors 50 (FIGS. 6 and 5), 47 and 49 (FIG. 5)) as a threshold-changing signal to transistors Q3 and Q4, (i.e., "reference controls" 14 and 16 noted above in connection with FIG. 4).

The forwardly-coupled signal from inverting amplifier U-7 is applied to comparator U-8 and, when this signal rises to a predetermined level constituting a system override condition, comparator U-8 switches, thereby energizing an indicator labeled "LED 1", through a series resistance R52 and a level-setting resistor R53. This provides a visual indication that the charge level on integrating capacitor C28 has reached the override threshold voltage determined by comparator U-8. Furthermore, the output of comparator U-8 is coupled to the inverting input of differential amplifier U-9, to whose output is also coupled the anode side of LED 1, and the resulting output from amplifier U-9 is coupled to one input of a second inverting amplifier U-10. The output of amplifier U-10 is coupled back, on conductor 901, to the non-inverting input of the aforementioned amplifier U-11 in path 940 (FIG. 5), whose function has been described previously, and also coupled back (on conductor 39) to the bases of switching transistors Q1 and Q2, to bring about system override, or lockout, as will be noted subsequently.

Accordingly, it will be seen that the input to terminal DL-4 of channel 920, representing the lower-frequency spectrum produced by the interrogation field-monitoring antennae, is utilized, with appropriate processing, to accomplish two distinct purposes. First, the peak-detected and integrated reflection of this input is coupled back to the bases of threshold reference-setting transistors Q3 and Q4, to change the threshold level of comparators U-1*a* and U-14*a* as a direct function of the instantaneous level of the low frequency spectrum produced by an object detected in the portals. Of course, the effect of this is to change in a very significant way the amounts of charge applied to and accumulated on integrating capacitor C9. This directly changes the relative conditions under which a logicial decision is made to either produce or not produce a marker-detection alarm, through that portion of circuit path 910 coupled to node 911 and including comparator U-4, timer U-5, and output driver Q7. That is, in the manner already described in a qualitative sense above, the determination that an object within the interrogation field is a genuine marker is made to be directly dependent upon the relative proportion of the high frequency spectrum (in the neighborhood of the fifteenth harmonic) with respect to the low frequency spectrum (primarily third and fourth harmonic) which that object is producing in the interrogation field. In this manner, by using the ratio of the detected frequency component bands as the requisite detection criteria, substantial and accurate discrimination is accomplished between actual markers and the myriad of other objects which produce more-or-less analogous interrogation field perturbations and which, if detected and indicated as being real markers, would provide a false and erroneous output indicating theft, pilfering, or the like where none was in fact taking place.

In accordance with the foregoing, and in accordance with the referenced and incorporated copending applications identified herein, it will now be appreciated that the present detection system provides a multiple-step or multi-layered approach for highly sensitive and yet highly selective detection of the low-coercivity permalloy or other such marker within the interrogation field, based upon the inevitably characteristic and relatively unique balance or ratio of low-order harmonics versus high-order harmonics caused by the magnetic domain-switching of the marker in response to each ensuring half-cycle of alternation of the interrogation field. Whereas many or even most metal objects will have some of the low-order harmonic band, and may even have an appreciable quantity of the high-order band, few if any non-marker objects will have the same characteristic ratio of high order to low order harmonic bands or component groupings; generally speaking, the higher-frequency harmonic band will be deficient in objects and articles which are not true markers, even though in a general sense substantial quantities of the higher-order harmonics may indeed be present, particularly in objects and articles which provide multiple magnetic paths or loops and which include at least some arcing points, i.e., gaps in the magnetic circuits.

Thus, the invention provides a method and means to determine the low-frequency components or band and the high-frequency components or band of an object within the interrogation field, and these low-frequency components are used to dynamically control the detection threshold of the high-frequency components which produce an alarm signal. In so doing, the signals from the antennae monitoring the interrogation field are carefully processed to produce two different types of signal output: one which represents the summation of the signals from the antennae, for maximum sensitivity, and the other of which represents the differencing of the signals from opposite sides of the interrogation field, for maximum selectivity. These two signals are separately processed to emphasize their respective high- and low-order harmonic content, and the signal with the high-order harmonic band is time-sampled in a manner such that the resulting samples are likely to accurately portray marker-presence signals on the one hand and marker-absence or ambient-level (noise-level) signals on the other hand. The resulting samples are then separately compared to a varying threshold reference which is provided by a peak-integrated signal representative of the detected object's low-order harmonic band, such that the higher the level of the latter signal, the higher the level which the marker-present signal must have in order to bring about a threshold-crossing in either of the two marker-present or marker-absence signal channels.

Whatever threshold crossings do result from the foregoing process are then in effect differenced and the result integrated cumulatively over the repeated cycles of the interrogation frequency during each successive phase-related burst thereof. Should the resulting integrated level exceed that indicative of the presence of a geniune marker within the interrogation field, an alarm is sounded. Conversely, if the peak-integrated signal representative of the low-order harmonic band becomes sufficiently large to exceed a predetermined threshold, indicating that the variable reference to which the high-order frequency samples are compared has become prohibitively large and is, in effect, blocking the detection channels, an indication of that status is given. Initially, this indication results from energizing an indicator light and, should the condition exist for a time period exceeding that attributable to some unusual but nonetheless expectable occurrence, a flashing alarm is enabled (via detector logic channel 940).

The condition just described, indicative of an unusual and undesirable situation prevalent within the interrogation field which is causing a substantial over-balancing of the detection circuitry by way of excessive levels of the low-frequency harmonic band, is a severe aberration in the detection circuit parameters, and thus indicates that advisability of fully inhibiting the detection circuitry, in addition to the flashing lamp indication just noted which shows the existence of the condition. Thus, the signal indicative of the low-frequency overbalance which is coupled back to channel 940 for the purpose of enabling and driving the flashing lamp indicator is also coupled back, on conductor 39, to each of the control switches 10 and 12 (transistors Q1 and Q2) such that they latch out and block the input from terminal DL-1, thereby preventing any build-up on integrator 34 (capacitor C9) which might otherwise result in an erroneous detection alarm.

In connection with the function and operation of detector logic channels 900 and 930, it is to be noted that the level of the instantaneously-variable detection threshold or reference on comparators U-1*a* and U-14*a*, set initially by voltage divider R14 and R1, and varied by proportional or relative conduction of transistors Q3 and Q4, is in effect stored for a short time interval on capacitors C7 and C8, coupled to the emitters of transistors Q4 and Q3, respectively, through a time constant-setting resistor R16 and R3, respectively. That is, the peak levels of threshold variation due to conductance of transistors Q3 and Q4 in response to elevated inhibit signals from integrating capacitor C28, are stored on capacitors C7 and C8 between phases; thus, these threshold peaks will be held briefly when the interrogation field switches its resultant flux direction in response to reversal in the phase of the drive excitation applied to one of the interrogation field-inducing coils. Thus, the system will not be susceptible to error as a result of detection harmonic content levels which vary substantially from one phase condition to the next. What is desired is to have enough storage in the system so that relatively high inhibit levels built up during one phase condition, which have effectively raised the threshold at the comparators to a substantial degree, will be maintained after the change in phase condition for at least the first half-cycle of the next interrogation field alternation and resulting detection signal, representative of a change in phase condition. For example, assuming the interrogation field fundamental frequency to be the aforementioned 10 kHz, utilizing a bleed-off time constant on the order of about 100 msec for capacitors C7 and C8 (the combined resistance of resistors R16 and R1 for C7 and R3 and R1 for C8), storage will be provided for an interval reasonably representative of the aforementioned period.

Of course, it is to be understood that the above is merely a description of certain preferred embodiments of the invention, and that various changes and alterations can be made without departing from the underlying concepts and broader aspects of the invention as set forth in the appended claims, which are to be interpreted in accordance with such underlying concepts and broader aspects and by application of a full range of equivalents.

The embodiments of the invention in which an exclusive property or privilege is claimed are defined as follows:

1. In a method of detecting the presence of a particular marker member within an electromagnetic interrogation field established between a pair of mutually spaced portal side members, wherein said electromagnetic field is made to alternate at one or more nominal frequencies and the field is monitored by at least first and second receiver means each disposed to access the field from a different side of said portal to detect the presence of signal indicia introduced by such a marker in response to its exposure to the alternations of the field, and wherein said receivers each produce an electrical signal representative of the frequency content of the alternating field at least in the area of proximity nearer to that receiver, the improvement for use in detecting said marker which comprises the steps of: producing a first composite electrical signal for marker-presence analysis by summing said electrical signals produced by said first and second receivers, to thereby increase detection sensitivity; producing a second composite electrical signal for use in marker-presence analysis by differencing said electrical signals produced by said first and second receivers, to reduce common-mode noise or other undesired signal characteristics in that composite electrical signal; comparatively examining representations of said first and second composite marker-presence signals with respect to one another to determine difference characteristics therebetween, and using such characteristics in said marker-presence determination.

2. The improvement for a marker-detection method as recited in claim 1, including the step of selectively treating said second composite marker-presence signal to reduce the presence therein of a predetermined frequency spectrum prior to said step of comparatively examining said first and second composite signals.

3. The improvement for a marker-detection method as recited in claim 1, including the steps of comparatively examining said first and second composite signals by using a representation of the first such signal to set a first value for a comparison operation, using a representation of the second such composite signal to set the other value for said comparison operation, and comparing the said first value with the said other value set for said comparison operation.

4. The improvement for a marker-detection method as recited in claim 1, including the steps of sampling said first composite marker-presence signal at at least two different points during its cyclic alternations, comparatively examining representations of each such signal sample with signals representative of said second composite marker-presence signal to produce mutually-representative resultant signals, and using said mutually-representative resultant signals as marker-presence signals in determining the presence of a marker within the interrogation field.

5. The improvement for a marker-detection method as recited in claim 4, including the step of selectively treating said second composite marker-presence signal to emphasize the presence therein of a predetermined frequency spectrum prior to said step of comparatively examining representations of said signal samples with representations of said second composite signals.

6. The improvement for a marker-detection method as recited in claim 5, including the steps of comparatively examining representations of said samples of said first composite signal by using said samples to set the value of a first comparison condition, using representations of the second such composite signal to vary a nominal value for a second comparison condition, and comparing the varied value of said second comparison condition with said value of said first comparison condition.

7. The improvement for a marker-detection method as recited in claim 6, including the steps of periodically changing at least certain of the alternation characteristics of said interrogation field, and maintaining a representation of the varied value of said second comparison condition signal for at least a brief interval bridging such periodic changes of alternation characteristics of the interrogation field, whereby a representation of said varied value is present at the commencement of the changed field alternation characteristics.

8. The improvement for a marker-detection method as recited in claim 7, wherein said step of periodically changing at least certain of the alternation characteristics of said interrogation field comprises periodically changing the resultant direction of at least portions of the magnetic flux in said field.

9. The improvement for a marker-detection method as recited in claim 8, wherein said step of changing magnetic flux direction comprises changing certain phase characteristics of an electrical excitation current applied to a field-inducing coil means.

10. In a method of detecting the presence of a particular marker member within an electromagnetic interrogation field established between a pair of mutually spaced portal side members, wherein said electromagnetic field is made to alternate at one or more nominal frequencies and the field is monitored by at least first and second receiver means each disposed to access the field from a different side of said portal to detect the presence of signal indicia introduced by such a marker in response to its exposure to the alternations of the field, and wherein said receivers each produce an electrical signal representative of the frequency content of the alternating field at least in the area of proximity nearer to that receiver, the improvement for use in detecting said marker which comprises the steps of: producing a first composite electrical signal for marker-presence analysis by summing the said electrical signals produced by said first and second receivers, to thereby increase detection sensitivity; producing a second composite electrical signal for use in marker-presence analysis by differencing the said electrical signals produced by said first and second receivers, to reduce common-mode noise or other undesired signal characteristics in that composite electrical signal combining selected characteristics of said two receiver-produced electrical signals to produce differently-constituted first and second analysis signals in a manner such that a first such analysis signal primarily includes the higher-order frequencies constituting said signals introduced by said marker, and such that a second such analysis signal primarily includes the lower-order of marker-introduced frequencies; using said second analysis signal to dynamically vary a reference value; comparing said first analysis signal to said varying reference value; and actuating an indicator at least partially in response to the result of said comparing.

11. The improvement for a marker-detection method as recited in claim 10, including the step of selectively treating said second composite marker-presence signal to emphasize the presence therein of a predetermined frequency spectrum prior to said step of comparatively examining said first and second composite signals.

12. The improvement for a marker-detection method as recited in claim 10, including the step of selectively emphasizing the content within said second analysis signal of a band of marker-introduced frequencies which comprises in major part the third and fifth harmonics of the said nominal frequency of the alternating interrogation field.

13. The improvement for a marker-detection method as recited in claim 12, including the step of selectively emphasizing the content within said first analysis signal of a band of marker-introduced frequencies which comprises in large part those higher-order harmonics of the interrogation field nominal frequency which have a frequency which is on the order of about three times that of the said harmonics selectively emphasized in the second analysis signal.

14. The improvement for a marker-detection method as recited in claim 13, including the steps of sampling signals which are representative of said first analysis signal at different points during the cyclic alternations of said first analysis signal, and using such signal samplings in said step of comparing to said varying reference by conducting sequential comparisons of the samplings with said varying reference.

15. The improvement for a marker-detection method as recited in claim 14, including the steps of carrying out a repeating sequence of said steps of sampling, separately comparing and summing over a plurality of successive cycles of alternation of the interrogation field and resulting cycles of the receiver-produced signals, and cumulatively summing the successive sequential composite comparison values.

16. The improvement for a marker-detection method as recited in claim 15, including the steps of periodically changing the resultant direction of the flux in said electromagnetic interrogation field, and synchronously with said periodic changes of interrogation field flux direction commencing new repeating sequences of said steps of sampling, separately comparing, summing, and cumulative summing of successive sequential composite comparison values.

17. The improvement for a marker-detection method as recited in claim 16, wherein said interrogation field is established by alternating electrical excitation currents and said periodic changes in the resultant direction of the flux in said field are representative of a plurality of cycles of alternation of said excitation current of a first phase condition followed by another plurality of cycles of current alternation of a second phase condition, and wherein said steps of sampling, separately comparing, summing and cumulative summing are carried out synchronously with the said cycles of the alternating excitation current in each of said phase conditions and said new repeating sequences are commenced synchronously with the said changes in phase condition of said excitation currents.

18. The improvement for a marker-detection method as recited in claim 17, including the step of maintaining in effect a representation of the varied value of said varying reference which was present prior to a change in said phase condition of interrogation field excitation currents for at least a predetermined interval lasting until the changed phase condition commences.

19. In a method of detecting the presence of a particular marker member within an electromagnetic interrogation field established between a pair of mutually spaced portal side members, wherein said electromagnetic field alternates at one or more nominal frequencies and the field is monitored by first and second receiver means to detect the presence of signal indicia introduced by said marker in response to its exposure to the alternations of the field, and wherein said receivers each produce an electrical signal representative of the frequency content of the alternating field at least in the area of proximity nearer that receiver, the improvement for use in detecting said marker which comprises the steps of: producing a first electrical signal for marker-presence analysis by sampling representations of the receiver-produced signals at a particular time during a cycle of the interrogation field alternations when marker-introduced signal indicia would be likely to occur if a marker were within the field; producing a second electrical signal for marker-presence analysis by sampling representations of the receiver-produced signals at a different particular time during a cycle of the interrogation field alternations, when marker-introduced signal indicia would not be likely to occur if a marker were within the field; processing the first and second electrical signals produced for marker-presence analysis by repeated differential summations of representations of the first such signal with respect to representations of the second such signal, and by cumulatively summing the results of said repeated differential summations over at least several cycles of the receiver-produced signals, to thereby produce a varying marker-presence signal value; and comparing the said varying marker-presence signal value to a reference in order to determine the presence of a marker member within said field.

20. The improvement for a marker-detection method as recited in claim 19, including the steps of comparing at least one of said first and second electrical signals produced for marker-presence analysis with a threshold value and using the resultant signal value from such comparing as the said representation of said one of said first and second electrical signals in said repeated differential summations whose results are cumulatively summed to produce said varying marker-presence signal value.

21. The improvement for a marker-detection method as recited in claim 20, including the steps of varying said threshold value from time to time between the instances of said comparing therewith of said at least one of said first and second electrical signals, said threshold being varied as a function of the frequency content of at least certain of said receiver-produced signals.

22. The improvement for a marker-detection method as recited in claim 20, including the steps of comparing both of said first and second electrical signals produced for marker-presence analysis with thresholds whose values are variably set as a function of the frequency content of representations of at least certain of said receiver-produced signals, and using the result of said comparing as the said representations of said first and second electrical signals in said repeated differential summations whose results are cumulatively summed to produce the said varying marker-present signal value.

23. The improvement for a marker-detection method as recited in claim 22, including the steps of varying said threshold at least partially as a function of the frequency content of representations of certain of said receiver-produced signals by subjecting said certain receiver-produced signals to selective amplification of a predetermined frequency spectrum contained therein, thereby establishing the resultant level of the selectively-amplified signals as a function of the frequencies contained therein corresponding to said spectrum; and using different values of said resultant level to vary said threshold.

24. The improvement for a marker-detection method as recited in claim 23, including the steps of comparing both said first and second electrical signals produced for marker-presence analysis with thresholds whose values are variably set by using said varying values of said resultant level of the selectively-amplified signals, and using the result of said comparing as the said representations of said first and second electrical signals in said repeated differential summations whose results are cumulatively summed to produce the said varying marker-present signal value.

25. The improvement for a marker-detection method as recited in claim 24, including the steps of varying said threshold value from time to time between the instances of said comparing therewith of said at least one of said first and second electrical signals, said threshold being varied as a function of a control signal produced at least in part by differencing the said electrical signals produced by said first and second receiver means.

26. The improvement for a marker-detection method as recited in claim 25, including the steps of determining the level of said control signal by subjecting it to frequency-selective amplification.

27. The improvement for a marker-detection method as recited in claim 19, wherein the said sampling of representations of the receiver-produced signals at a time during a cycle of the interrogation field when marker-induced signal indicia would not be likely to occur is carried out for an interval shorter than a quarter-cycle of the alternations of the interrogation field nominal frequency.

28. The improvement for a marker-detection method as recited in claim 19, wherein the said sampling of representations of the receiver-produced signals at a time during a cycle of the interrogation field when marker-induced signal indicia would be likely to occur is carried out for an interval which is on the order of the same length of time as a quarter-cycle of the alternations of the interrogation field nominal frequency.

29. The improvement for a marker-detection method as recited in claim 28, wherein the said sampling of representations of the receiver-produced signals at a time during a cycle of the interrogation field when marker-induced signal indicia would not be likely to occur is carried out for an interval shorter than a quarter-cycle of the alternations of the interrogation field nominal frequency.

30. In a method of detecting the presence of a particular marker member within an electromagnetic interrogation field established between a pair of mutually spaced portal side members, wherein said electromagnetic field alternates at one or more nominal frequencies and the field is monitored by first and second receiver means each disposed to access the field from a different side of said portal to detect the presence of signal indicia introduced by such a marker in response to its exposure to the alternations of the field, and wherein said receivers each produce an electrical signal representative of the frequency content of the alternating field at least in the area of proximity nearer to that receiver, the improvement for use in detecting said marker which comprises the steps of: producing an alarm-inhibit signal at least in part by subjecting representations of at least certain of said receiver-produced signals to frequency-content-representative integration, including the steps of performing frequency-selective amplification of said certain of said receiver-produced signals and peak-integration of the resulting frequency-selective amplified signals; and conditionally comparing the resulting integration signal with other representations of the receiver-produced signals in a manner such that the higher the level of the said alarm-inhibit integration signal the higher the said other representations of receiver-produced signals must be to cause indication of marker-presence within the interrogation field.

31. The improvement for a marker-detection method as recited in claim 30, wherein said step of peak-integration is carried out by use of electronic integration utilizing an integration time constant whose period is about on the same order as the cycle period of the said frequency-selective amplified signals.

32. The improvement for a marker-detection method as recited in claim 30, including the steps of producing representations of said receiver-produced signals for said frequency-content-representative integration at least in part by differencing the signals produced by said first and said second receiver means prior to such integration.

33. In a method of determining the presence of a predetermined marker member within an alternating electromagnetic field by use of one or more detectors which produce electrical signals containing indicia indicative of the presence of such a marker within such field, the improvement comprising the steps of:

operating upon said detector-produced electrical signals to produce first and second analysis signals having mutually different indicia content representative of the presence of said marker within said field;

sampling at least one of said analysis signals at different points in time and separately comparatively examining representations of said samples with respect to representations of the other of said analysis signals, to thereby produce a succession of comparison result values;

comparatively differencing at least certain of said comparison result values;

cumulatively summing the results of said comparative differencing of comparison result values, and using said cumulative summation as a determinant in indicating the presence or non-presence of such a marker within said field.

34. The improvement for a marker-presence method as recited in claim 33, wherein said step of comparatively differencing said comparison result values is accomplished by subtracting a magnitude representative of signal samples from one time condition from a magnitude representative of signal samples from another time condition.

35. The improvement for a marker-presence method as recited in claim 34, wherein said step of cumulatively summing said comparison result values comprises summing a plurality of the different magnitudes resulting from a succession of said magnitude subtraction steps.

36. The improvement for a marker-presence method as recited in claim 35, wherein said step of summing a plurality of different magnitudes comprises integrating a succession of signal cycle portions.

37. The improvement for a marker-presence method as recited in claim 36, wherein said step of using said cumulative summation as a determinant in indicating the presence or non-presence of a marker within the field comprises applying the product of said integration to a comparator as a variable input, comparing such input to a reference, and actuating an indicator in the event that the said variable input crosses a threshold representative of the reference.

38. Apparatus for detecting the presence of a particular marker member within an alternating electromagnetic interrogation field established between a pair of mutually spaced portal side members and having at least one nominal frequency of alternation, comprising in combination: first and second receiver means each disposed to access the field from a different side of said portal and adapted to detect the presence of such a marker within said field by producing an electrical signal representative of the frequency content of the alternating field at least in the area of proximity nearer to that respective receiver; means for producing a first composite electrical signal for marker-presence analysis by summing the said electrical signals produced by said first and second receivers, and for producing a second composite electrical signal for use in marker-presence analysis by differencing the said electrical signals produced by said first and second receivers; and means for comparatively examining representations of said first and second composite marker-presence signals with respect to one another to determine difference characteristics therebetween, and for using such characteristics to determine the presence of such marker within said field.

39. The apparatus for marker detection as recited in claim 38, wherein said means for comparatively examining said first and second composite signals includes electronic comparator apparatus, and means for applying a representation of the first such signal to said comparator apparatus to set a first value for comparison and for applying a representation of the second such composite signal to said comparator apparatus to set the other value for said comparison, said comparator apparatus adapted to compare the said first value with the said other value.

40. The apparatus for marker detection as recited in claim 39, including means for sampling said first composite marker-presence signal at at least two different points during its cyclic alternations, means for comparatively examining representations of each such signal sample with signals representative of said second composite marker-presence signal to produce mutually-representative resulting signals, and means for determining the presence of a marker within the interrogation field as a function of said mutually-representative resultant signals.

41. Apparatus for detecting the presence of a particular marker member within an alternating electromagnetic interrogation field established between a pair of mutually spaced portal side members and having at least a first nominal frequency of alternation, comprising in combination: first and second receiver means each disposed to monitor said field from a different side of said portal to detect the presence of signal indicia introduced by such a marker in response to its exposure to the alternations of the field, said receivers each adapted to produce an electrical signal representative of the frequency content of the alternating field at least in the area of proximity nearer to that receiver; means for combining selected characteristics of said two receiver-produced electrical signals to produce differently-constituted first and second analysis signals in a manner such that a first such analysis signal primarily includes the higher-order frequencies constituting said signals introduced by said marker, and such that a second such analysis signal primarily includes the lower-order marker-introduced frequencies; means for using said second analysis signal to dynamically vary a reference value; means for comparing said first analysis signal to said varying reference value; and means for actuating an indicator at least partially in response to the result of said comparing.

42. The apparatus for marker detection as recited in claim 41, including means for sampling signals which are representative of said first analysis signal at different points during the cyclic alternations of said first analysis signal, and means for comparing such signal samplings to said varying reference value by conducting sequential comparisons of the samplings with said varying reference value.

43. The apparatus for marker detection as recited in claim 42, including means for separately comparing at least certain of said signal samplings with the varying reference value to produce separate comparison values, and means for summing at least certain of the said separate comparison values over certain increments of time to produce composite comparison values.

44. The apparatus as recited in claim 43, wherein at least certain of the alternation characteristics of said interrogation field are periodically changed, and including means for maintaining a representation of the varied value of said varying reference present just prior to such a periodic interrogation field change for at least a predetermined interval bridging such periodic changes of alternation characteristics of the interrogation field, whereby a representation of the varied value is carried forward to the beginning of the period of changed alternation characteristics.

45. The apparatus as recited in claim 43, including means for repeatingly and sequentially sampling, separately comparing and summing said separate comparison values over a plurality of successive cycles of alternation of the interrogation field and corresponding cycles of the receiver-produced signals, and for cumulatively summing the successive sequential composite comparison values.

46. The apparatus as recited in claim 45, wherein the resultant direction of the flux in said electromagnetic interrogation field is periodically changed, and including means for periodically commencing new repeating sequences of said sampling, separately comparing, summing, and cumulative summing of successive sequential composite comparison values synchronously with said periodic changes of interrogation field flux direction.

47. In an apparatus for detecting the presence of a particular marker member within an electromagnetic interrogation field established between a pair of mutually spaced portal side members, wherein said electromagnetic field alternates at one or more frequencies and the field is monitored by first and second receiver means which detect the presence of signal indicia introduced by said marker in response to its exposure to the alternations of the field by producing an electrical signal representative of the frequency content of the alternating field at least in the area of proximity nearer that receiver, the improvement comprising: means for producing a first electrical signal for marker-presence analysis by sampling representations of the receiver-produced signals at a particular time during a cycle of the interrogation field alternations when marker-introduced signal indicia would be likely to occur if a marker were within the field; means for producing a second electrical signal for marker-presence analysis by sampling representations of the receiver-produced signals at a different particular time during a cycle of the interrogation field alternations, when marker-introduced signal indicia would not be likely to occur if a marker were within the field; means for processing said first and second electrical signals produced for marker-presence analysis by repeated differential summations of representations of the first such signal with respect to representations of the second such signal, and by cumulatively summing the results of said repeated differential summations over at least several cycles of the receiver-produced signals, to thereby produce a varying marker-presence signal value; and means for comparing the said varying marker-presence signal value to a reference in order to determine the presence of a marker member within said field.

48. The improvement as recited in claim 47, including comparator circuit means for comparing at least one of said first and second electrical signals produced for marker-presence analysis with a threshold value, and summing means for using the resultant signal value from said comparator circuit means as the said representation of said one of said first and second electrical signals and for making repeated differential summations of such first and second signal representations to cumulatively sum such signal representations and thereby produce said varying marker-presence signal value.

49. The improvement as recited in claim 48, including means for varying said threshold value from time to time between the instances of said comparing, as a function of the frequency content of at least certain of said receiver-produced signals.

50. In an apparatus for detecting the presence of a particular marker member within an electromagnetic interrogation field established between a pair of mutually spaced portal side members, wherein said electromagnetic field alternates at one or more nominal frequencies and the field is monitored by first and second receiver means each disposed to access the field from a different side of said portal to detect the presence of signal indicia introduced by such a marker in response to its exposure to the alternations of the field by producing an electrical signal representative of the frequency content of the alternating field at least in the area of proximity nearer to that receiver, the improvement comprising: means for producing an alarm-inhibit signal at least in part by subjecting representations of at least certain of said receiver-produced signals to frequency-content-representative integration and differentially summing the resulting integration signal with other representations of the receiver-produced signals in a manner such that the higher the level of the said alarm-inhibit integration signal the higher the said other representations of receiver-produced signals must be to cause indication of marker-presence within the interrogation field.

51. The improvement as recited in claim 50, including means for frequency-selective amplification of said certain of said receiver-produced signals and for peak-integration of the resulting frequency-selective amplified signals.

52. The improvement as recited in claim 51, wherein said means for peak-integration comprises an electronic integration circuit having an integration time constant whose period is about on the same order as the cycle period of the said frequency-selective amplified signals.

53. In a method of detecting the presence of a particular marker member within an electromagnetic interrogation field established between a pair of mutually spaced portal side members, wherein said electromagnetic field is made to alternate at one or more nominal frequencies and the field is monitored by at least first and second receiver means each disposed to access the field from a different side of said portal to detect the presence of signal indicia introduced by such a marker in response to its exposure to the alternations of the field, and wherein said receivers each produce an electrical signal representative of the frequency content of the alternating field at least in the area of proximity nearer to that receiver, the improvement for use in detecting said marker which comprises the steps of: producing at least one resultant receiver signal by resolving together representations of the respective electrical signals produced by said first and second receiver means; producing differently-constituted first and second analysis signals representative of actual marker detection by using said resultant signal produced from the first and second receiver signal representations, a first so-produced analysis signal primarily including the higher-order frequencies constituting said signals introduced by said marker and a second so-produced analysis signal primarily including the lower-order of marker-introduced frequencies; using representations of said second analysis signal to dynamically vary a reference threshold value; sampling said first analysis signal at each of at least two mutually different points during the cycle of alternation of said electromagnetic field and of the corresponding cyclic alternation of said electrical signals produced by said receiver means; dynamically comparing at least certain of the samples of said analysis signal taken at the different cycle points with said dynamically-varying reference threshold values to produce a sequence of dynamically varying indicator signal values; and actuating an indicator as a function of the instantaneous level of said sequence of dynamically-varying indicator signal values.

54. The improvement for a marker-detection method as recited in claim 53, including the steps of dynamically comparing a succession of the samples of said analysis signal taken a succession of times at comparable points during individual different cycles of alternation of the receiver means electrical signals with a corresponding succession of the values of the dynamically-varying reference threshold, and using such succession of dynamic comparisons to produce a pair of separate varying indicator signals; dynamically combining the said pair of separate varying indicator signal values; and actuating said indicator as a function of the dynamic value of said combined pair of indicator signal values.

55. The improvement for a marker-detection method as recited in claim 54, wherein said step of dynamically combining the pair of separate indicator signal values comprises differentially combining such values to form a composite value.

56. The improvement for a marker-detection method as recited in claim 55, including the steps of sampling said first analysis signal at said two mutually different points during an individual cycle for a plurality of different succeeding such cycles in a sequence thereof, conducting a sequence of successive comparisons with said dynamically-varying threshold reference values for successive different cycle samples to produce a sequence of successive indicator signal values; summing at least certain of said successive indicator signal values by differentially combining them; summing the resulting sequential indicator signal values; and actuating an indicator as a function of the resulting value of said last recited summing step.

* * * * *

UNITED STATES PATENT AND TRADEMARK OFFICE

CERTIFICATE OF CORRECTION

PATENT NO. : 4,524,350

DATED : June 18, 1985

INVENTOR(S) : Larry Eccleston

It is certified that error appears in the above-identified patent and that said Letters Patent is hereby corrected as shown below:

Column 2, line 54:
"likw" should be --- like ---;

Column 3, line 26:
"interrrogation" should be --- interrogation ---;

Column 7, line 14:
"inputds" should be --- inputs ---;

Column 8, line 6:
"iinputs" should be --- inputs ---;

Column 14, line 23:
"DS-2" should be --- DL-2 ---;

Column 15, line 36:
"a" should be --- as ---;

Column 17, line 14:
"930" should be ---920---;

Column 17, line 61:
"91" should be --- 911 ---;

Column 18, line 20:
"FIg. 6" should be --- Fig. 6 ---;

UNITED STATES PATENT AND TRADEMARK OFFICE

CERTIFICATE OF CORRECTION

PATENT NO. : 4,524,350

DATED : June 18, 1985

INVENTOR(S) : Larry Eccleston

It is certified that error appears in the above-identified patent and that said Letters Patent is hereby corrected as shown below:

Column 25, Claim 19, line 52:
"processing the" should be --- processing said ---;

Column 30, Claim 47, line 18:
Before "frequencies" insert --- nominal ---.

Signed and Sealed this

*Eleventh* Day of *February 1986*

[SEAL]

*Attest:*

DONALD J. QUIGG

*Attesting Officer* *Commissioner of Patents and Trademarks*